US011236505B2

(12) United States Patent
Rivas et al.

(10) Patent No.: US 11,236,505 B2
(45) Date of Patent: Feb. 1, 2022

(54) PANELIZED STRUCTURAL BUILDING SYSTEM

(71) Applicant: Cover Technologies, Inc., Gardena, CA (US)

(72) Inventors: Alexis Xavier Rivas, Gardena, CA (US); Connor Holjes, Gardena, CA (US); Craig Derian, Gardena, CA (US); Jemuel Joseph, Gardena, CA (US); Jose Morales, Gardena, CA (US); Thomas Heyer, Gardena, CA (US); Zachary Winoker, Gardena, CA (US)

(73) Assignee: Cover Technologies, Inc., Gardena, CA (US)

( * ) Notice: Subject to any disclaimer, the term of this patent is extended or adjusted under 35 U.S.C. 154(b) by 0 days.

(21) Appl. No.: 16/875,079

(22) Filed: May 15, 2020

(65) Prior Publication Data

US 2020/0385982 A1 Dec. 10, 2020

Related U.S. Application Data

(60) Provisional application No. 62/848,377, filed on May 15, 2019.

(51) Int. Cl.

| | |
|---|---|
| ***E04B 1/00*** | (2006.01) |
| ***E04B 1/61*** | (2006.01) |
| ***E04B 1/14*** | (2006.01) |
| ***E04B 1/76*** | (2006.01) |
| ***E04F 13/08*** | (2006.01) |

(Continued)

(52) U.S. Cl.

CPC ..... *E04B 1/6187* (2013.01); *E04B 1/14* (2013.01); *E04B 1/7608* (2013.01); *E04B 5/023* (2013.01); *E04C 2/292* (2013.01); *E04C 2/30* (2013.01); *E04C 2/46* (2013.01); *E04C 2/50* (2013.01); *E04F 13/0803* (2013.01);

(Continued)

(58) Field of Classification Search

None

See application file for complete search history.

(56) References Cited

U.S. PATENT DOCUMENTS 949,394 A * 2/1910 Daly ..... E04B 1/2403 403/173
D342,662 S * 12/1993 Lavin, Sr. ..... D8/354
5,431,211 A * 7/1995 Guillemet ..... E06B 9/52 160/381

(Continued)

*Primary Examiner* — Basil S Katcheves
(74) *Attorney, Agent, or Firm* — Run8 Patent Group LLC; Peter Miller; Alexander Rodriguez

(57) ABSTRACT

One variation of a panelized structural building system includes, a set of wall panels, each including: an outer face; a set of hardpoints, each arranged proximal a corner of the outer face, defining a lateral wall panel datum facing outwardly from a side of the wall panel, and defining an exterior façade mount facing outwardly from the outer face; and a load-bearing structure extending between the set of hardpoints and inset from a maximal wall panel perimeter defined by the set of hardpoints; wherein the set of wall panels are assemblable into a wall with lateral wall panel datums—defined by hardpoints in adjacent wall panels—abutting to laterally space the set of wall panels along the wall. The system also includes a set of exterior façade panels configured to install onto exterior façade mounts—defined hardpoints in adjacent wall panels—to conceal outer faces of these wall panels.

20 Claims, 5 Drawing Sheets

(51) Int. Cl.

| | |
|---|---|
| ***E04B 5/02*** | (2006.01) |
| ***E04C 2/30*** | (2006.01) |
| ***E04B 2/00*** | (2006.01) |
| ***E04C 2/292*** | (2006.01) |
| *E04C 2/00* | (2006.01) |

(52) U.S. Cl.
CPC ... *E04B 2001/6191* (2013.01); *E04B 2103/06* (2013.01); *E04C 2002/001* (2013.01)

(56) References Cited

U.S. PATENT DOCUMENTS 7,806,630 B2 * 10/2010 Hawkins ..... E02B 3/064 405/220
9,441,359 B1 * 9/2016 Hsieh ..... E04B 1/3483
9,869,122 B2 * 1/2018 Isaacs ..... E06B 1/32
D893,290 S * 8/2020 Wojcik ..... D8/382
2003/0041549 A1 * 3/2003 Simmons ..... F16B 9/09 52/655.1
2003/0192271 A1 * 10/2003 Koutras ..... E04B 2/7405 52/285.1
2006/0265992 A1 * 11/2006 Hiragaki ..... E04B 5/43 52/633
2007/0271857 A1 * 11/2007 Heather ..... B65D 90/0026 52/79.9
2008/0282631 A1 * 11/2008 Breimer ..... E04G 21/161 52/271
2010/0242400 A1 * 9/2010 Sawyers ..... A47G 1/10 52/656.9
2010/0287848 A1 * 11/2010 Pepin ..... E04B 1/3483 52/79.9
2011/0303813 A1 * 12/2011 Lijesnic ..... F16B 12/50 248/309.1
2013/0036702 A1 * 2/2013 Pacetti ..... E04H 1/1205 52/653.2
2016/0002909 A1 * 1/2016 Bowron ..... B66C 1/66 52/125.2
2018/0094426 A1 * 4/2018 Winter ..... E04B 1/003
2018/0208388 A1 * 7/2018 Austerberry ..... E04C 2/284
2018/0274230 A1 * 9/2018 Schreck ..... A47B 47/0091

* cited by examiner

PANELIZED STRUCTURAL BUILDING SYSTEM

CROSS-REFERENCE TO RELATED APPLICATIONS

This Application claims the benefit of U.S. Provisional Application No. 62/848,377, filed on 15-May-2019, which is incorporated in its entirety by this reference.

TECHNICAL FIELD

This invention relates generally to the field of prefabricated structures and more specifically to a new and useful panelized structural building system in the field of prefabricated structures.

DESCRIPTION OF THE EMBODIMENTS

The following description of embodiments of the invention is not intended to limit the invention to these embodiments but rather to enable a person skilled in the art to make and use this invention. Variations, configurations, implementations, example implementations, and examples described herein are optional and are not exclusive to the variations, configurations, implementations, example implementations, and examples they describe. The invention described herein can include any and all permutations of these variations, configurations, implementations, example implementations, and examples.

1. System

Figure 1A:
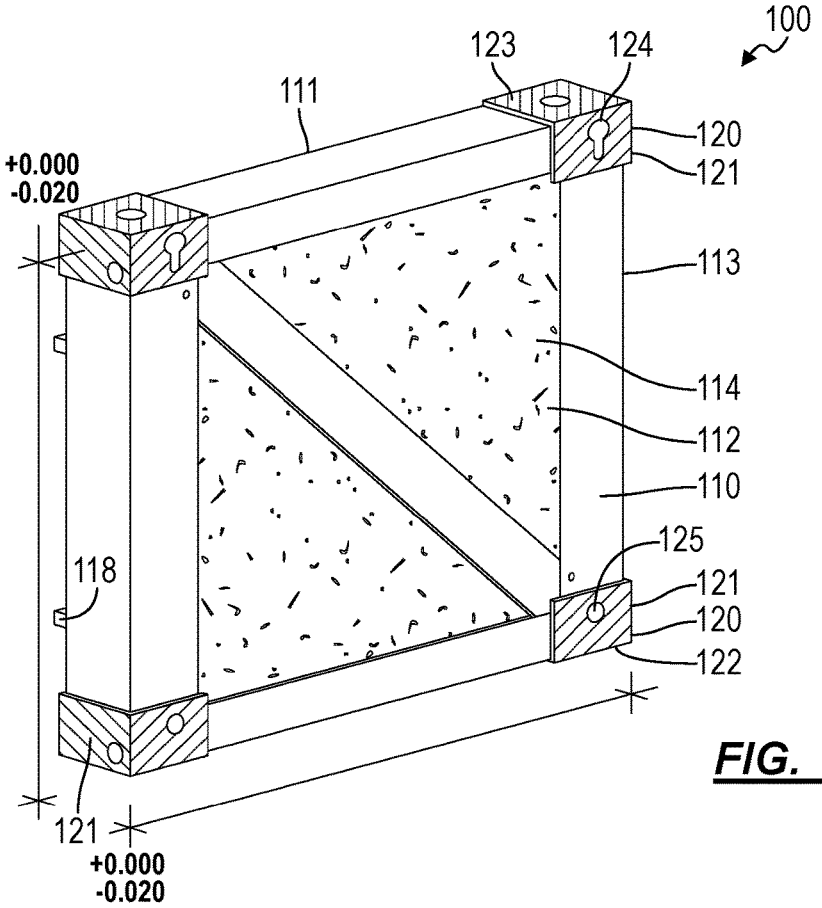
FIGS. 1A and 1B are isometric representations of a panelized structural building system.
Figure 1B:
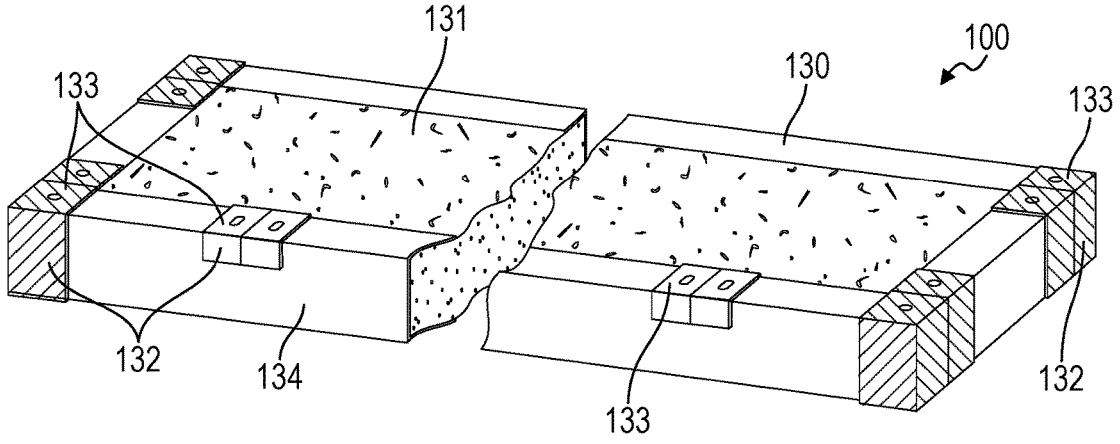

As shown in FIGS. 1A and 1B, a panelized structural building system 100 includes a wall panel 110 and a floor panel 130. The wall panel 110 includes: an outer wall face defining a rectangular geometry; a set of wall panel hardpoints 120 defining wall panel datums at corners of the outer wall face 112; and a load-bearing structure 113 coupled to the set of wall panel hardpoints 120 and inset from a maximal wall panel 110 perimeter defined by the wall panel datums. The floor panel 130 includes: an exterior floor face defining a rectangular geometry; a set of floor panel hardpoints 132 defining vertical floor panel datums 133 along a top edge of the exterior floor face; and a load-bearing structure 134 coupled to the set of floor panel hardpoints 132 and inset from a maximal floor panel 130 dimension defined by the vertical floor panel datums 133. The set of floor panel hardpoints 132 are configured to mate with and locate the set of wall panel hardpoints 120 to form a structure.

Figure 4:
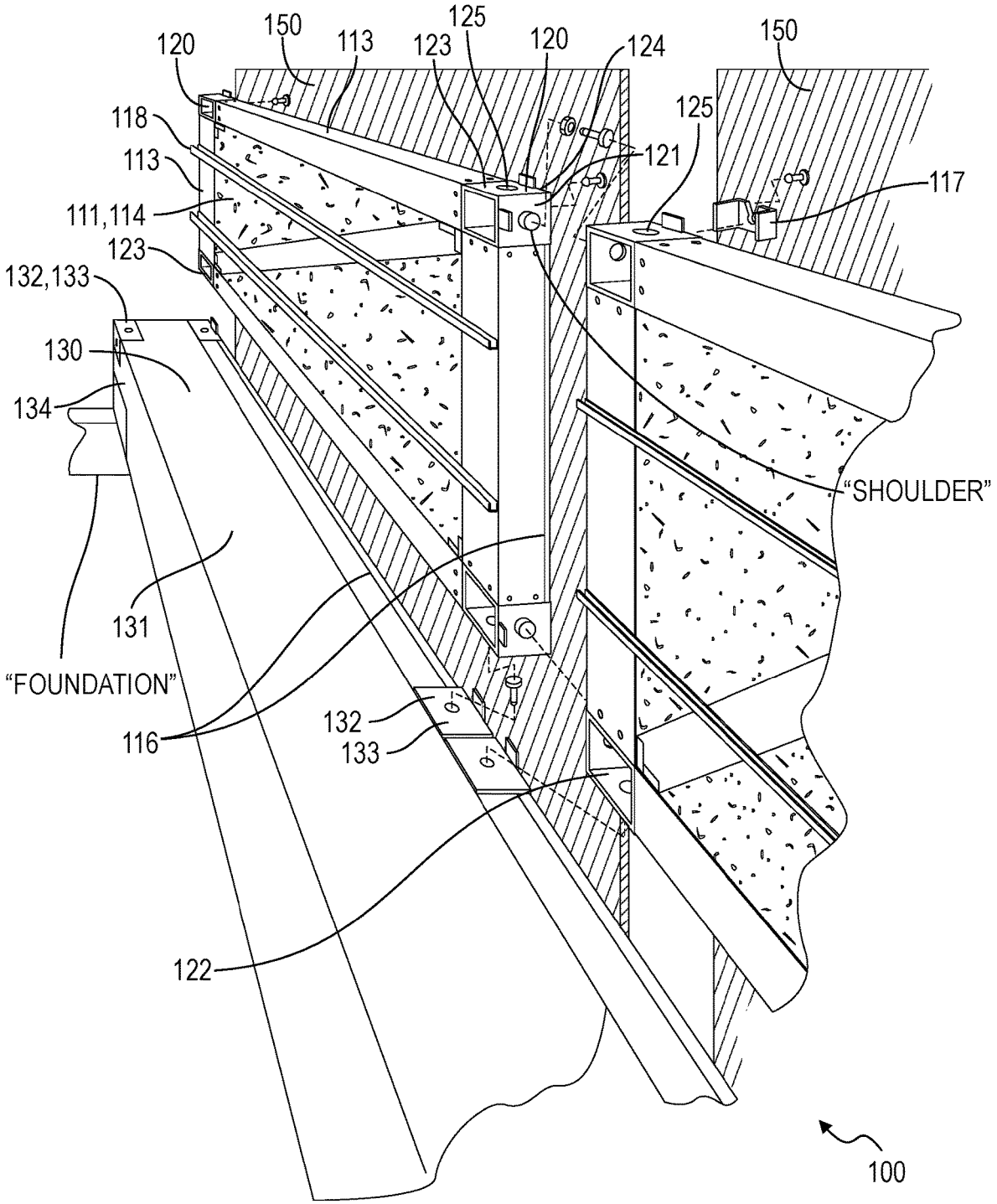
FIG. 4 is an isometric view of one variation of the panelized structural building system.

In a similar variation shown in FIG. 4, the panelized structural building system 100 includes a set of wall panels

110, wherein each wall panel 110 in the set includes: an outer wall face defining a first rectilinear geometry; a set of wall panel hardpoints 120 defining a constellation of vertical wall panel datums 122, 123 and lateral wall panel datums 121 proximal corners of the outer wall face; and a load-bearing structure 113 extending between the set of wall panel hardpoints 120 and inset from a maximal wall panel 110 perimeter defined by the constellation of wall panel datums. In this variation, the panelized structural building system 100 also includes a first floor panel 130, which includes: a first outer floor face 131 defining a second rectilinear geometry; a first set of floor panel hardpoints 132 defining a first row of vertical floor panel datums 133 proximal a top edge of the first outer floor face; and a first wall-bearing structure 134 coupled to the first set of floor panel hardpoints 132 and inset from a first maximal floor panel 130 dimension defined by the first row of vertical floor panel datums 133. In this variation of the panelized structural building system 100, the set of wall panels 110 are: assemblable onto the first floor panel 130 with the first row of vertical floor panel datums 133 vertically locating vertical wall panel datums 122, 123, defined by wall panel hardpoints 120 in the set of wall panels 110, over the first floor panel 130; and assemblable into a first wall with lateral wall panel datums 121, defined by wall panel hardpoints 120 in adjacent wall panels 110 in the set of wall panels 110, abutting to laterally space the set of wall panels 110 along the first row of vertical floor panel datums 133.

Figure 5:
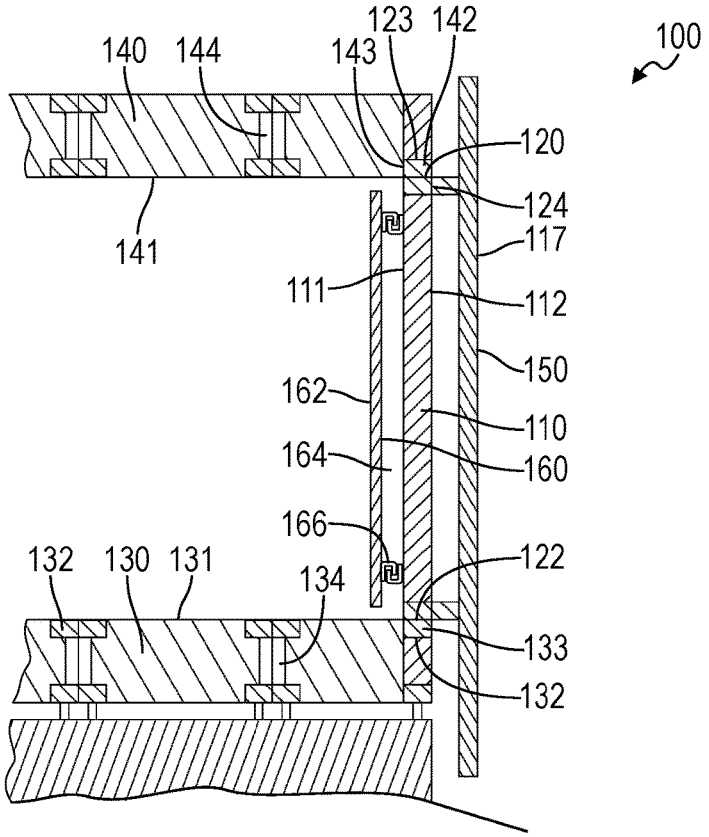
FIG. 5 is a cross-sectional elevation view of one variation of the panelized structural building system.

In another variation shown in FIG. 5, the panelized structural building system 100 includes a set of wall panels 110 and a set of exterior façade panels 150. In this variation, each wall panel 110 in the set includes: an outer wall face; a set of wall panel hardpoints 120, each arranged proximal a corner of the outer wall face, defining a lateral wall panel datum 121 facing outwardly from a side of the wall panel 110, and defining an exterior façade mount 124 facing outwardly from the outer wall face; and a load-bearing structure 113 extending between the set of wall panel hardpoints 120 and inset from a maximal wall panel 110 perimeter defined by the set of wall panel hardpoints 120. In this variation, the set of wall panels 110 are assemblable into a wall with lateral wall panel datums 121, defined by wall panel hardpoints 120 in adjacent wall panels 110 in the set of wall panels 110, abutting to laterally space the set of wall panels 110 along the wall; and the set of exterior façade panels 150 are configured to install onto exterior façade mounts 124—defined by sets of wall panel hardpoints 120 of wall panels 110 in the set of wall panels 110—to conceal outer wall faces of wall panels 110 in the set of wall panels 110.

Figure 3:
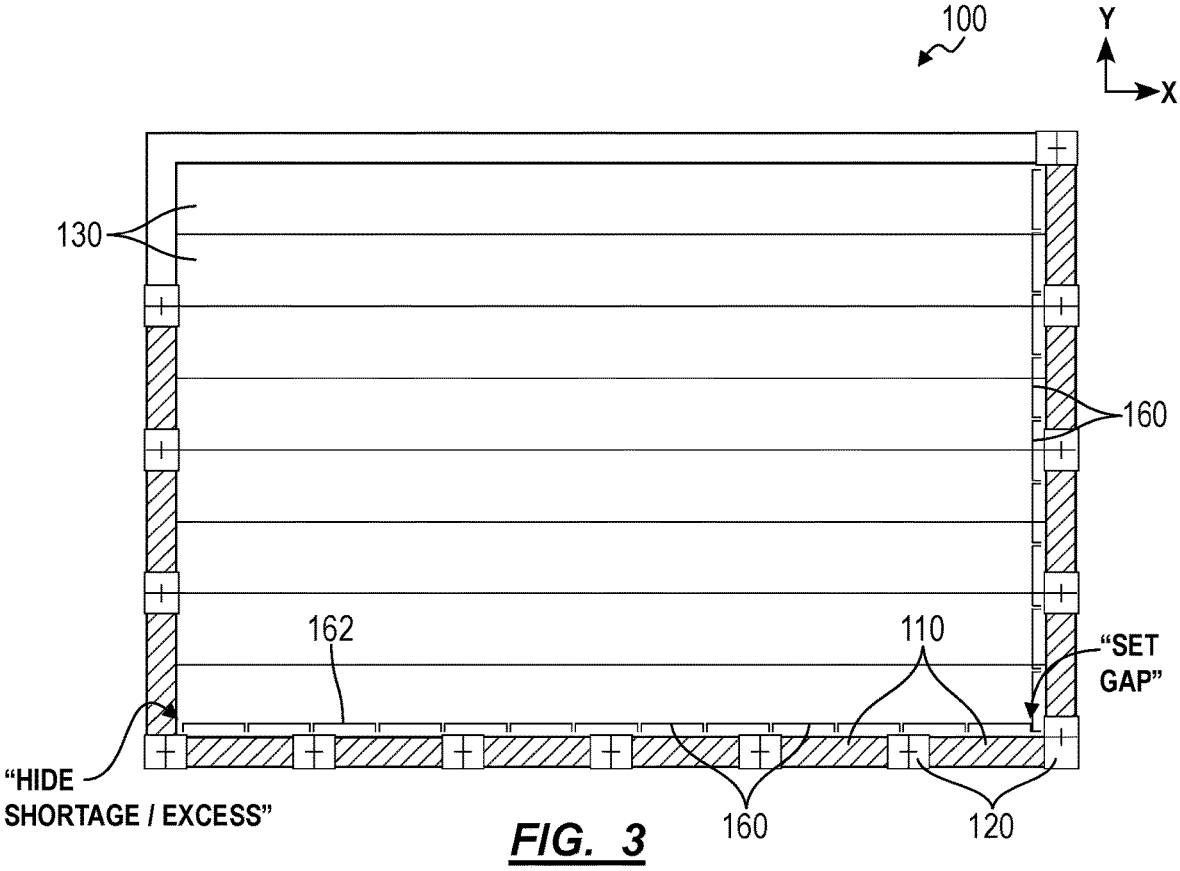
FIG. 3 is a plan view of one variation of the panelized structural building system.

In another variation shown in FIGS. 3 and 5, the panelized structural building system 100 includes a set of wall panels 110 and a set of interior finish panels 160. In this variation, each wall panel 110 in the set includes: an inner wall face 112 defining a first width; an interior wall hanger 118 extending laterally across the inner wall face 112; a set of wall panel hardpoints 120, each arranged proximal a corner of the inner wall face 112 and defining a lateral wall panel datum 121 facing outwardly from a side of the wall panel 110; and a load-bearing structure 113 extending between the set of wall panel hardpoints 120 and inset from a maximal wall panel 110 perimeter defined by the set of wall panel hardpoints 120. Each interior finish panel 160 in the set includes: a finished interior face 162 defining a second width different from the first width; a rear face 164 opposite the finished interior face 162; and a mounting feature 166 arranged on the rear face 164. In this variation, the set of wall panels no are assemblable into a wall: with lateral wall panel datums 121, defined by wall panel hardpoints 120 in adjacent wall panels no in the set of wall panels 110, abutting to laterally space the set of wall panels no along the wall; and with interior wall hangers 118, of the set of wall panels 110, aligning to form a continuous track along a length of the wall. Furthermore, in this variation, the set of interior finish panels 160 are configured to install onto the continuous track to conceal inner wall faces 112 of wall panels no in the set of wall panels 110.

2. Applications

Generally, the panelized structural building system 100 includes a set of prefabricated structural floor, wall, and roof panels that are constructed offsite and assembled (e.g., for the first time) onsite to form a complete, habitable building (e.g., a house, a pool house, a cabin, a multi-family residential apartment, a carriage house) with little or no onsite (structural) customization (e.g., or on-site trimming or modification) of these panels themselves. In particular, wall panels no in this system include: hardpoints 120 that define vertical and horizontal datums for accurate, repeatable connection to corresponding datums defined by hardpoints 120 in floor and roof panels; and structural, load-carrying elements that connect these hardpoints 120 both vertically and laterally but do not extend beyond datums (e.g., planar surfaces) defined by these hardpoints 120 (or otherwise remain clear of features on adjacent panels), thereby preventing interference between these structural elements 113 in the wall panel 110 and adjacent floor and roof panels when these components are assembled, ensuring accurate location of the wall panel 110 on a floor panel 130, and similarly ensuring accurate location of a roof panel on the wall panel 110.

Figure 7:
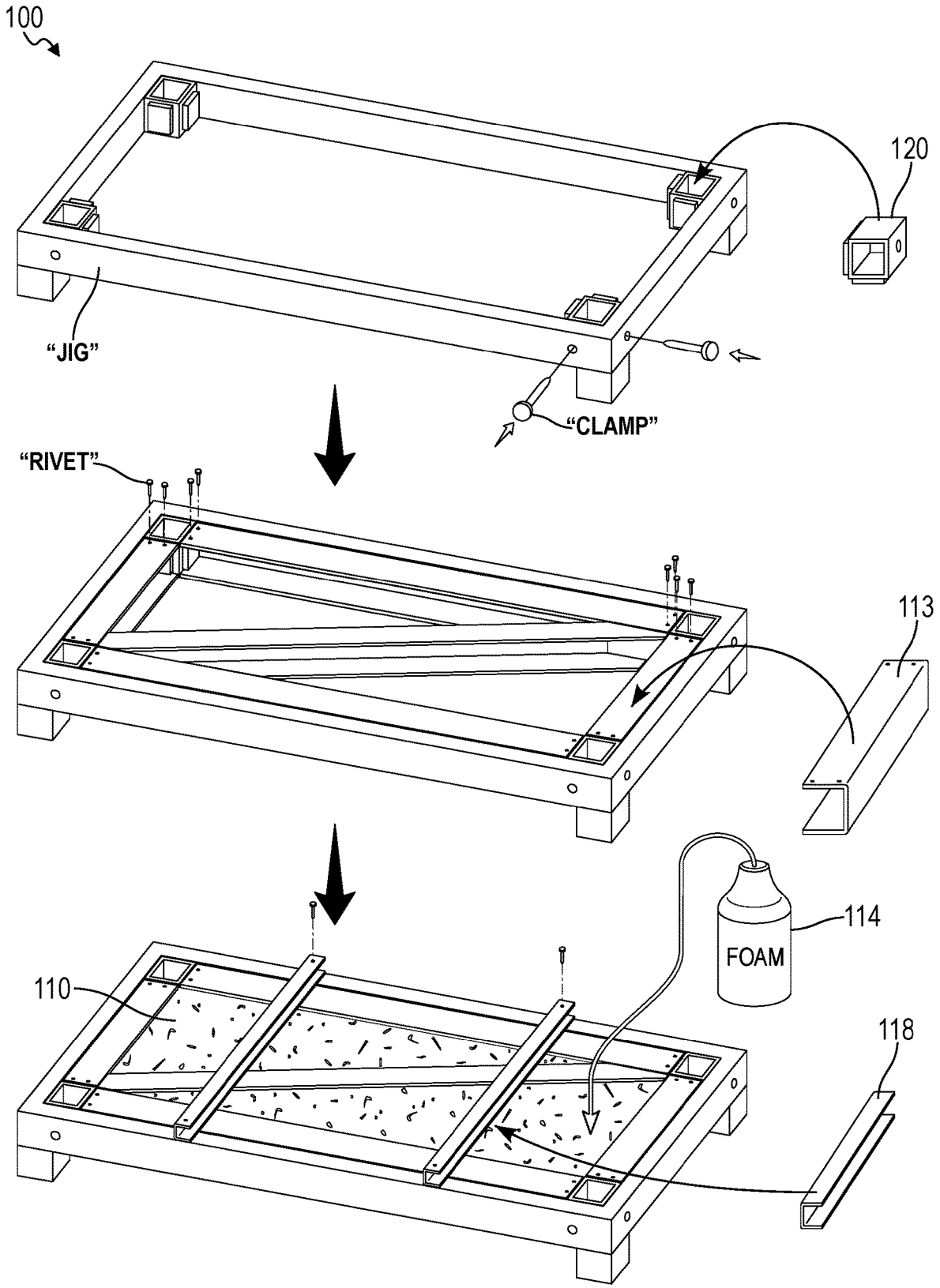
FIG. 7 is a flowchart of one variation of the panelized structural building system.

For example and as shown in FIG. 7, a wall panel 110 can be fabricated in a high-precision jig by locating hardpoints 120 in corner of a rectangular wall panel jig with datum features (e.g., planar surfaces) defined by these hardpoints 120 constrained against corresponding features in the wall panel jig. Structural elements 113 (e.g., sheetmetal studs, structural foam, sill plates, and top plates) can then be fastened, bonded, or welded to these hardpoints 120, and precast structural foam panels or expanding structural foam can then be inserted around these hardpoints 120 and structural elements 113 to complete the structural features of the wall panel 110. Because the wall panel jig defines a maximal geometry of the wall panel 110, because hardpoints 120 in the wall panel 110 are assembled onto datum features in the wall panel jig, and because remaining structural elements 113 are assembled around these hardpoints 120 and inside of the maximal geometry defined by the wall panel jig, dimensions of the completed wall panel 110 thus constructed on this wall panel jig—as measured at maximal features of this wall panel 110—may fall within a very tight tolerance, such as +0.000"/−0.020" for a 48"-wide, ice-tall nominal dimension of the wall panel 110 at a standard production temperature of 72° F.

Therefore, hardpoints 120—defining datums for accurately and repeatably locating the wall panel 110 relative to adjacent wall panels 110, a floor panel 130 below, and a roof panel above—can be fixed within a tight tolerance on nominal dimension, planarity, straightness, and/or flatness, etc. within the wall panel jig. Separate structural (i.e., load-carrying) elements can then be assembled around these hardpoints 120 to carry vertical and shear loads between these hardpoints 120, and an insulator 114 can be installed, injected, cast, or molded, etc. between these structural elements 113 to complete the wall panel 110. Thus, the wall panel 110 can include separate, discrete locating elements (i.e., hardpoints 120), load-carrying elements, and a discrete insulating element(s).

Additional wall panels 110 fabricated on this same wall panel jig (and other wall panel jigs of different geometries (e.g., 24"-wide and 36"-wide, 100"-tall panels)) at similar temperatures may therefore exhibit similarly-tight tolerances. Floor and roof panels can be similarly constructed on similar floor and roof panel jigs and may therefore exhibit similarly tight tolerances.

Therefore, the panelized structural building system 100 can include a set of floor, wall, and roof panels, each of which includes a set of features (e.g., hardpoints) that define datums for accurate, repeatable location on adjacent structural panels in the panelized structural building system 100 such that a large (e.g., a 20'-wide by 40' long) structure assembled from these structural panels exhibits high dimensional and geometric accuracy. Such high dimensional and geometric accuracy of the structure may then enable prefabricated interior and exterior façade panels 150 to be assembled onto this structure to complete the building with little or no customization (e.g., or on-site trimming or modification) of these façade elements without sacrificing final fit and finish of the building as a whole.

Furthermore, by segmenting walls, floors, and roofs for a structure into smaller panels, these structural panels may be sufficiently lightweight to enable an installation team to maneuver these structural panels into position, such as by hand with only low-weight lift and maneuver assist tooling (e.g., a handtruck) and without a crane, forklift, or other heavy equipment. For example, an installation team may assemble structural panels in the panelized structural building system 100 into a poolhouse or backyard office by carrying these structural panels by hand to a side of a house, through a side gate, and into a backyard area without the use of a crane.

Floor, wall, and roof panels are described herein as constructed and assembled to form a building with a rectangular floor plan; however, floor, wall, and roof panels can be assembled to form a structure defining a floor plan of any other size or geometry.

3. Jigs

Generally, a higher-expense, high-precision wall panel jig can be implemented to precisely locate (e.g., +0.000/−0.020" in nominal width, flatness, straightness, and planarity) hardpoints 120 in a wall panel 110 in the panelized structural building system 100. While these hardpoints 120 are precisely located in the jig, structural elements 113 in the wall panel no can be constructed—with loose tolerances—around this set of hardpoints 120. More specifically, features that will locate this wall panel no relative to other structural panels in the panelized structural building system 100 (e.g., adjacent wall, floor, and roof panels) are thus constrained by the jig at known locations with tight dimensional and geometric tolerances. Load-carrying structural elements 113 in this wall panel 110—which do not control location of the wall panel 110 relative to other structural panels in the panelized structural building system 100—are thus assembled with lower precision (and therefore at reduced cost) around the hardpoints 120 in the jig without sacrificing final fit and alignment of this wall panel 110 within the greater structure, which is controlled by datums defined by these hardpoints 120, which are thus located accurately and repeatably by the jig, as shown in FIG. 7.

This wall panel jig can be reused to create many (e.g., hundreds, thousands of) panels of the same nominal dimension and geometry (within a tight tolerance, such as +0.000"/−0.020") over time. For example, a small number of wall panel jigs—such as including 100"-tall by 24"-, 36"-, and 48"-wide wall panel jigs) may be sufficient to construct nearly all wall panels 110 for a wide range of buildings representing a wide range of unique footprint sizes and geometries. Floor and roof panels for these structures can be similarly constructed with a small number of floor panel jigs (e.g., 24"-wide by 8'-, 12'-, 20'-long floor panel jigs) and a small number of roof panel jigs (e.g., 24"-wide by 8'-, 12'-, 20'-long roof panel jigs) or on the same floor panel jigs. A set of panels can therefore be produced on these jigs remotely from a job site and then precisely assembled—by abutting datums in these panels—locally to form a (unique) structure without modification or custom fitting of these panels at the job site. In another example, a single wall panel jig defines a fixed wall panel height (e.g., 100") and an adjustable wall panel width, such as a series of 24",36", and 48" insert positions that form one side of a wall panel.

Furthermore, because dimensions and geometries of hardpoints in these structural panels are tightly controlled by these jigs, interior finish panels 160 and exterior façade panels 150 sized for these structural panels can be installed over these structural panels to complete the building with tight, consistent gapping between interior finish and exterior façade panels 150 without necessitating customization (e.g., on-site trimming or modification) of these interior and exterior façade panels 150. Therefore, each structural panel incorporating hardpoints for location and assembly with adjacent structural panels can exhibit high geometric and dimensional accuracy of surfaces configured to mate with other structural panels within the panelized structural building system 100 due to high-precision remote fabrication of this structural panel. These structural panels can thus enable rapid local assembly of a building with little or no onsite customization (e.g., or on-site trimming or modification) of these structural panels and other subsystems while concurrently yielding more consistent, accurate, and repeatable fit between all finished interior and exterior surfaces.

4. Datums

A jig can therefore define tight-tolerance locating features that mate with and precisely locate datums defined by hardpoints within one structural panel such that these datums will accurately and repeatably locate this structural panel relative to adjacent wall, floor, and ceiling panels during subsequent assembly of a structure.

4.1 Edge-Centric Tight-Tolerance Locating Features

In one implementation shown in FIGS. 1 and 4, hardpoints in structural panels define edge-centric datums. In one example, a set of (e.g., two) floor panel hardpoints 132—located along top edges of floor panels 130—define primary horizontal surfaces configured: to carry vertical loads from a wall panel 110 above into structural elements 134 of the floor panel 130; and to locate and constrain this wall panel 110 in two degrees of freedom (e.g., translation along a "z" axis and rotation about an "x" axis). In this example, a set of (e.g., two) wall panel hardpoints 120—located along a bottom edge (e.g., near two bottom corners) of the wall panel 110—can similarly define primary planar surfaces configured: to mate with the primary horizontal surfaces defined by this set of floor panel hardpoints 132; and to transfer vertical loads from the wall panel 110 into the floor panel 130 below.

In the foregoing example, floor panel hardpoints 132 in the floor panel 130 can also define raised (or recessed) shoulders: of controlled dimension and geometry (e.g., height, depth, internal corner profile), such as along their exterior edges; and configured to mate with and locate receivers (e.g., recessed or raised receivers)—of similarly controlled dimension—along corresponding wall panel hardpoints 120. Shoulders in a pair of floor panel hardpoints 132 can therefore cooperate with corresponding receivers in a pair of wall panel hardpoints 120 to locate and constrain this wall panel 110 relative to this floor panel 130 in two degrees of freedom (e.g., translation along the "x" axis and rotation about a "z" axis).

In this example, other floor and wall panels 110 can include similar floor panel and wall panel hardpoints 132, 120 of similar geometry and that similarly cooperate to constrain these wall panels 110 relative to the floor panel 130 in these degrees of freedom. Connection of perpendicular groups of wall panels 110—over an assembly of floor panels 130—can also locate and constrain these wall panels 110 in two final degrees of freedom (e.g., translation along a "y" axis and rotation about the "y" axis).

In this implementation, these wall panel hardpoints 120 can also include both: lateral datums defining primary planar surfaces configured to mate with primary planar surfaces of lateral datums of adjacent wall panels 110; and depth datums configured to set a depth of an edge of a first wall panel 110 relative to an adjacent second edge of a second wall panel 110. In one example shown in FIG. 4, each wall panel 110 allocated for one wall in a building can include: a top-left hardpoint 120 and a bottom-left hardpoint 120 defining primary planar surfaces facing outwardly from the left side of the wall panel 110 and secondary male datum surfaces (e.g., shoulders) extending outwardly from the left side of the wall panel 110; and a top-right hardpoint 120 and a bottom-right hardpoint 120 defining primary planar surfaces facing outwardly from the right side of the wall panel 110 and secondary female datum surfaces (e.g., recesses) configured to mate with secondary male datum surfaces extending outwardly from the left side of an adjacent wall panel 110. Thus, when these wall panels 110 are assembled laterally to form a wall: primary planar surfaces in adjacent wall panel hardpoints 120 in these wall panels 110 can mate in order to automatically set (i.e., control) lateral offsets between these wall panels 110; and secondary datum surfaces in adjacent wall panel hardpoints 120 in these wall panels 110 can mate in order to automatically set depth offsets between outer wall faces 112 of these wall panels 110 (e.g., to locate exterior façade panel 150 mounts defined by these wall panel hardpoints 120 in a common plane).

Thus, in this implementation, during assembly of a set of structural panels, operators may: visually verify that adjacent edges on the outer wall faces 112 of adjacent hardpoints on two abutting panels fall on (or within a maximum tolerance of) the same plane; and then fasten these structural panels together, such as with: undersized bolts or clevis pins passing through smooth bores in these hardpoints; wedges; or undersized turnbuckles threaded into smooth or threaded bores in these hardpoints.

4.2 Hole-Centric Datums

In another implementation shown in FIG. 4, hardpoints in structural panels define hole-centric datums. In one example, floor and wall panel hardpoints 120 define primary horizontal surfaces that vertically locate and constrain wall panels 110 over floor panels 130 and transfer vertical loads between these structural panels, as described above. However, in this implementation, the hardpoints can also define smooth bores—of tightly-controlled dimension, circularity, and concentricity relative to the primary horizontal surfaces in these hardpoints—that function as both datums for aligning adjacent structural panels and receivers for fastening these structural panels together. In this example, shoulder bolts including shoulders of tightly-controlled dimension (e.g., running fit in the smooth bores of the hardpoints) can be passed through coaxial bores in abutting hardpoints in two adjacent structural panels during assembly in order to accurately and repeatably locate these structural panels relative to one another. Nuts and washers can then be tightened over these shoulder bolts to complete assembly of these structural panels.

5. Wall Panel

Figure 6:
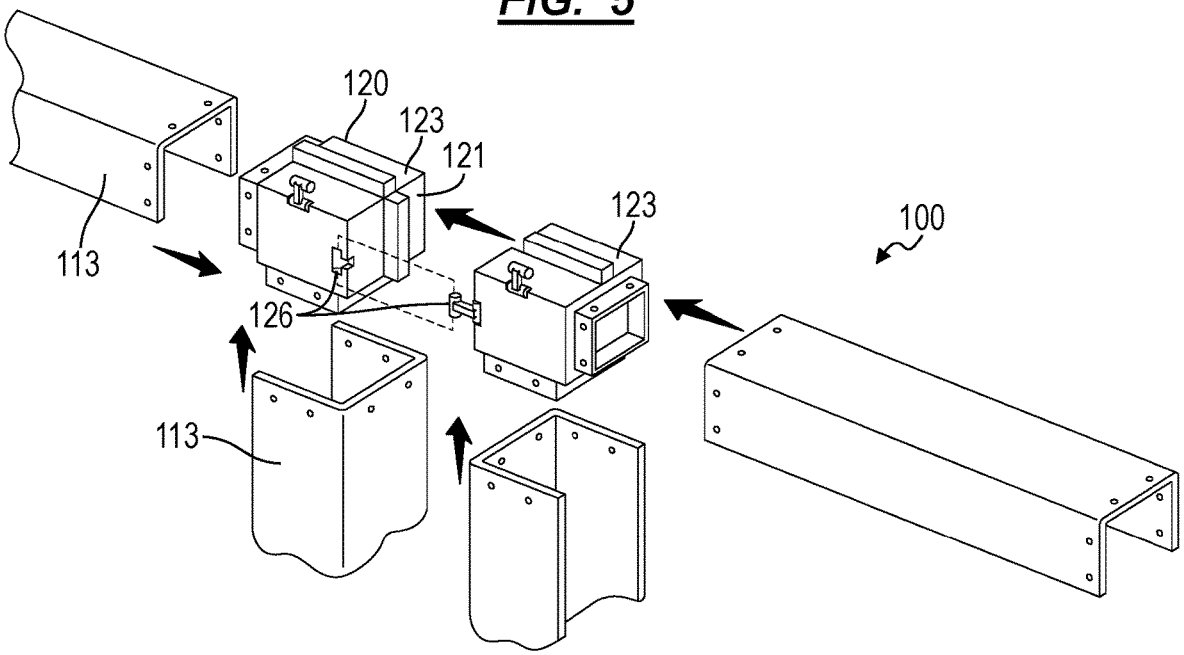
FIG. 6 is an isometric view of one variation of the panelized structural building system.

As described above and shown in FIGS. 1A, 4, and 6, a wall panel 110 includes: an outer wall face 112 defining a rectilinear (e.g., rectangular) geometry; a set of wall panel hardpoints 120 defining wall panel datums at corners of the outer wall face 112; and a load-bearing structure 113 coupled to the set of wall panel hardpoints 120 and inset from a maximal wall panel no perimeter defined by the wall panel datums (or otherwise arranged relative to the wall panel datums to avoid interference with features on an adjacent panel).

Generally, a wall panel no includes: hardpoints 120 that define maximum dimensions of the wall panel 110 and datums for locating the wall panel 110 on adjacent structural panels; and structural elements 113 that carry vertical and/or shear forces between a roof panel above and a floor panel 130 below.

In one implementation, a wall panel no defines a full single-floor height (e.g., ~100") and one of a range of widths, such as up to a maximum width corresponding to a maximum weight that may be carried and maneuvered by two crewmen (e.g., 54"-wide, up to 120 pounds). In this implementation, the width of the wall panel 110 can be selected to meet vertical load-carrying requirements of the structure. For example, narrow wall panels no may enable more hardpoints 120 to be incorporated per unit length of a completed wall within a structure and may therefore support more vertical load paths between hardpoints 120 and thus more load-carrying capacity per linear foot of wall constructed with a set of panels and may therefore be selected for taller structures, structures with multiple floors, or structures with heavier roof systems. Conversely, a wider wall panel no may be selected for building locations with greater local seismic requirements or wind sheer forces. However, a wall panel no can define any other geometry.

(Alternatively, the wall panel 110 can exclude discrete structural elements 113, and hardpoints 120 within the wall panel 110 can be coupled and retained by a foam insulator 114 or other polymer insulator introduced into and hardened within the jig while the wall panel hardpoints 120 are retained in the jig during production of the wall panel 110.)

5.1 Wall Structure: Hardpoints

In one implementation shown in FIG. 1A, a wall panel no includes one hardpoint 120 located at each of its four corners. Each wall panel hardpoint 120 can define a set of datum surfaces that repeatably locate and constrain this wall panel 110 relative to other adjacent structural panels.

In one example, a lower wall panel hardpoint 120 defines: a bottom-facing planar surface configured to mate with and to transfer vertical loads downward into an upward-facing planar surface defined by a floor panel hardpoint 132 in an adjacent floor panel 130 in order to vertically locate the wall panel 110 on the floor panel 130; a front- (or rear-) facing surface (e.g., a ridge, semi-cylindrical surface) perpendicular to the bottom-facing planar surface and configured to mate with the rear- (or front-) facing surface defined by the adjacent floor panel hardpoint 132 in order to longitudinally locate the wall panel 110 on the floor panel 130; and a lateral (i.e., "side-facing") planar surface perpendicular to the bottom- and front-facing surfaces and configured to mate with a lateral surface defined by a lower wall panel hardpoint 120 in an adjacent wall panel 110 in order to longitudinally locate these wall panels 110 relative to one another. Similarly, an upper wall panel hardpoint 120 can define: a top-facing planar surface configured to mate with and to communicate vertical loads from a downward-facing planar surface defined by a roof panel hardpoint 142 in an adjacent roof panel in order to vertically locate the roof panel over the wall panel 110; a front- (or rear-) facing surface perpendicular to the top-facing planar surface and configured to mate with the rear- (or front-) facing surface defined by the adjacent roof panel hardpoint 142 in order to longitudinally locate the roof panel on the wall panel 110; and a lateral planar surface perpendicular to the upper- and front-facing surfaces and configured to mate with a lateral surface defined by an upper wall panel hardpoint 120 in an adjacent wall panel no in order to longitudinally locate these wall panels 110 relative to one another.

A lower wall panel hardpoint 120 can also define features that enable the hardpoint to be fastened or otherwise coupled to an adjacent wall panel 110 and adjacent floor panel 130. For example, the bottom-facing surface of the lower wall panel hardpoint 120 can define a first bore configured to receive a threaded fastener (or a rivet, a weld bead, an adhesive) to fasten this hardpoint to an adjacent floor panel hardpoint 132 in an abutting floor panel 130; similarly, the lateral surface of this lower wall panel hardpoint 120 can define a second bore configured to receive a threaded fastener to fasten this hardpoint to an adjacent wall panel hardpoint 120 in an abutting wall panel 110. In the edge-centric datum implementation described above, the first and second datums can be sized for a loose running fit with these threaded fasteners. Alternatively, in the bore-centric datum implementation described above, the first and second datums can be sized for a clearance or transition fit with these threaded fasteners. An upper wall panel hardpoint 120 can similarly define features that enable the hardpoint 120 to be fastened or otherwise coupled to an adjacent wall panel 110 and adjacent roof panel 140.

In one implementation, wall panel hardpoints 120 also define features configured to locate and retain exterior façade panels 150 (e.g., rainscreen panels). For example, exterior-facing surfaces of wall panel hardpoints 120 can define locating features (e.g., round or keyhole bores) configured to receive pins or threaded fasteners extending from the inner façade face of an exterior façade panel 150. Thus, once a structure of floor, wall, and room panels are assembled to form a building, an exterior façade panel 150 can be installed over one wall panel 110 by inserting pins or shoulder bolts extending from each corner of the exterior façade panel 150 into the exterior-facing slotted bore in the corresponding hardpoint 120 of one wall panel 110, and this process can be repeated for each other wall panel 110 in order to complete assembly of the façade of the building.

In a similar example, the wall panel 110 can include: an outer wall face; and a set of wall panel hardpoints 120, each defining an exterior façade mount 124 facing outwardly from the outer wall face of the wall panel 110. In this example, each exterior façade mount 124 can include a cleat 117 configured to directly engage a shoulder or other feature extending rearward from (proximal) a corresponding corner of an exterior façade panel 150. Alternatively, each exterior façade mount 124 can include a smooth or threaded bore, a pin or slot, or another datum and mounting feature; and the panelized structural building system 100 can further include a set of separate cleats 117 configured to mount directly to these exterior façade mounts 124 during assembly of the building.

5.1.1 Hardpoint Construction

A hardpoint can be sandcast, diecast, sintered, molded, fabricated (e.g., welded), additively-manufactured (or "printed"), and/or machined (e.g., from billet), such as in steel, aluminum, nylon, fiberglass, carbon fiber, or any other structural material.

In one implementation, a hardpoint can include a five-sided steel fabricated cube with one open face facing the interior side of the wall panel 110. For example, the wall panel 110 can include a pair of lower wall panel hardpoints 120: in the form of metal cuboid structures of a first thickness (e.g., steel cuboid structures fabricated in ¼" (or 3-gauge) steel plate); that define the left and right lower corners of the wall panel 110; that define a pair of opposing lower lateral wall panel datums 121 facing outwardly from the left and right sides of the wall panel 110; and that define a pair of lower vertical wall panel datums 122 facing downwardly from a bottom of the wall panel 110. In this example, the wall panel 110 can similarly include a pair of upper wall panel hardpoints 120: in the form of metal cuboid structures of a first thickness (e.g., steel cuboid structures fabricated in ¼" (or 3-gauge) steel plate); that define the left and right upper corners of the wall panel 110; that define a pair of opposing upper lateral wall panel datums 121 facing outwardly from the left and right sides of the wall panel 110; and that define a pair of upper vertical wall panel datums 122 facing outwardly from a top of the wall panel 110.

Furthermore, a wall panel hardpoint 120 in a lower corner of a wall panel 110 can define any other geometry spanning multiple datum surfaces, such as including: a lateral datum surface configured to mate with a lower lateral datum surface of an adjacent wall panel 110 to repeatably and accurately set a spacing between lower corners of this wall panel 110 and the adjacent wall panel 110; a lower vertical datum surface configured to mate with a vertical datum surface of an adjacent floor panel 130 to repeatably and accurately set a spacing between this wall panel no and the adjacent floor panel 130; and an exterior façade mount 124 configured to locate and mount an adjacent corner (or edge) of an exterior façade panel 150 relative to these lateral and lower vertical datums. Similarly, a wall panel hardpoint 120 in an upper corner of a wall panel 110 can define any other geometry spanning multiple datum surfaces, such as including: a lateral datum surface configured to mate with an upper lateral datum surface of an adjacent wall panel no to repeatably and accurately set a spacing between uppers corners of this wall panel 110 and the adjacent wall panel 110; an upper vertical datum surface configured to mate with a vertical datum surface of an adjacent roof panel 140 to repeatably and accurately set a spacing between this wall panel 110 and the adjacent roof panel 140; and an exterior façade mount 124 configured to locate and mount an adjacent corner (or edge) of an exterior façade panel 150 relative to these lateral and upper vertical datums.

For example, in the foregoing implementations, a pair of lower wall panel hardpoints 120 can define a pair of opposing lower lateral wall panel datums 121 offset by a target wall panel 110 width dimension (e.g., 48"), within a tolerance range of +0.000" and −0.020"—such as to yield a maximum width of 48.000" and a minimum width of 47.980" between these lower lateral wall panel datums 121. Similarly, in this example, a pair of upper wall panel hardpoints 120 can define a pair of opposing upper lateral wall panel datums 121 offset by the target wall panel 110 width dimension, within a tolerance range of +0.000" and −0.020"—such as to yield a maximum width of 48.000" and a minimum width of 47.980" between these upper lateral wall panel datums 121. Similarly, the upper-left and lower-left hardpoints can be located in the wall panel 110 such that the lateral wall panel datums 121 defined by these hardpoints fall within the same plane, within a tolerance range of +/−0.010"; the upper-right and lower-right hardpoints can be located in the wall panel 110 such that the lateral wall panel datums 121 defined by these hardpoints also fall within the same plane, within a tolerance range of +/−0.010"—such as to yield a maximum effective width of 48.010" and a minimum effective width of 47.970" across these wall panel datums. Furthermore, a row of ten such wall panels 110 assembled over a floor panel 130 may yield a wall exhibiting a maximum effective length of 40'-0.10" and a minimum effective length of 39'-11.70".

The vertical floor and roof panel datums 133, 143 defined by these hardpoints can be similarly toleranced. Each vertical floor and roof panel datum 133, 143 can also be located within a narrow perpendicularity tolerance—such as +/−0.1°—to the lateral wall panel datums 121 defined by its corresponding hardpoint.

5.2 Structural/Load-Bearing Elements

As shown in FIG. 1A, a wall panel 110 also includes structural elements 113 configured to connect hardpoints in the corners of the wall panel 110.

In one implementation, these structural elements 113 include perimeter casing components: extending between hardpoints along the top, bottom, left, and right sides of the wall panel 110; mechanically fastened, bonded, or otherwise coupled to these hardpoints; configured to carry vertical load between upper and corresponding lower hardpoints in the wall panel 110; and configured to maintain rigid lateral location of hardpoints on the left side of the wall panel 110 relative to hardpoints on the right side of the wall panel 110. For example, these structural elements 113 can include formed or fabricated sheetmetal sections, such as 20- or 22-gauge galvanized steel bend into elongated U-channel sections. In another example, these structural elements 113 can include molded, extruded, or pultruded fiberglass structural elements 113.

Furthermore, each structural element can be of a thickness that is (significantly) less than a thickness of a hardpoint in the same wall panel 110 (e.g., 20-gauge and 3-gauge, respectively) and/or can exhibit (significantly) less torsional rigidity than hardpoints in the same wall panel no. Therefore, these structural elements 113 may twist and deform when mated (e.g., riveted, bonded, fastened) to the hardpoints during fabrication of the wall panel 110—rather than cause the jig or hardpoints to deform or cause these hardpoints to separate from the jig during fabrication of the wall panel no in the jig.

Therefore, a set of structural elements 113 can be arranged along the perimeter of the wall panel 110 to couple the lower wall panel hardpoints 120 and the upper wall panel hardpoints 120 in this wall panel 110 and to form a first load-bearing structure 113 that carries vertical and lateral loads between these hardpoints.

Furthermore, these structural elements 113 can be inset inside of a maximal wall panel no perimeter of the wall panel 110 defined by the hardpoints, such as offset inside this maximal wall panel 110 perimeter by between −0.020" and −0.120", in order to eliminate possibility of interference between these structural elements 113 in the wall panel no and adjacent structural elements 113 in an abutting floor or roof panel 130, 140 when later assembled into a structure.

In one variation, these structural elements 113 also include cross-bracing welded, fastened, or bonded between hardpoints at opposing corners for increased shear strength of the completed wall panel 110. Structural elements 113 can also be arranged vertically in the wall panel 110 and inset from the wall panel hardpoints 120 to increase vertical load capacity of the wall panel 110.

5.3 Insulative Component

The wall panel 110 can also include an insulator 114 occupying a volume between the set of structural elements 113 and hardpoints 120. More specifically, the wall panel 110 can include an insulative component arranged inside the maximal perimeter of the wall panel 110 thus defined by the wall panel hardpoints 120. For example, the insulative component can include precast structural foam elements inserted into cavities between the hardpoints 120 and structural elements 113 and bonded (e.g., with adhesive or expanding foam) to these hardpoints 120 and structural elements 113.

Alternatively, the insulator 114 can include expanding foam that can be injected into these cavities and cast in place within the wall panel 110 during fabrication within the jig. For example, the insulator 114 can include a closed-cell foam molded within the wall panel 110 to: form a secondary structure between the structural elements 113 and the hardpoints 120; to incorporate thermal insulation directly into the wall panel 110; and to define a water-impermeable barrier (e.g., a vapor barrier) across the inner and outer wall faces 111, 112 of the wall panel 110.

Alternatively the insulator 114 can be pre-formed to a size of a wall panel 110, and wall panel hardpoints 120 can be pressed into or bonded to the insulator 114 at their target locations to complete assembly of the wall panel 110. Thus, in this implementation, the insulator 114 can also function as the load-bearing structure 113 in the wall panel 110 (i.e., the insulator 114 and the load-bearing structure 113 can be physically coextensive).

In another implementation, the insulator 114 occupies a volume between two load-bearing sheet structures that sandwich wall panel hardpoints 120 in the corners of a wall panel to form a "sandwich constructure" wall panel 110.

5.4 Interior Wall Hangers

In one variation shown in FIGS. 4 and 5, the wall panel 110 includes an interior wall hanger 118 mechanically fastened, bonded, cast, or molded in-place across an inner wall face 112 of the wall panel 110 and configured to locate and support an interior finish panel 160, as described below.

5.5 Wall Panel Fabrication

In one implementation shown in FIG. 7, to fabricate a wall panel 110, a wall panel jig is first selected or adjusted for a target nominal wall panel 110 dimension (e.g., 48" by 100"30 0.000/−0.020"). Then: four hardpoints 140 are fastened to the jig with their datums mating with reference features defined by the jig; a first plastic sheet (e.g., 0.002"-thick plastic sheet) is placed in the base of the jig (and caulked or sealed) around the hardpoints 120; structural elements 113 are riveted or spot-welded between hardpoints in the jig; a second layer of plastic sheet is placed over the jig, hardpoints 120, and structural elements 113; a jig cover is located over the jig; and an expanding foam is injected through a bore in the jig cover, through a hole in the second plastic sheet, and into a cavity bounded by the hardpoints 120, the structural elements 113, the first and second plastic sheets with the first and second plastic sheets functioning to isolate the expanding foam from interior surfaces of the jig and jig cover. Once this expanding foam is cured: the jig cover is released; interior panel hangers are located on datums defined by the jig and fastened or bonded over the second plastic sheet, such as with self-tapping sheetmetal screws passing through the structural elements 113; the hardpoints 120 are unfastened from the jig; and the wall panel 110 is extracted from the jig. An adhesive-backed moisture barrier 115 can then be applied to the outer wall face 112 of the wall panel 110; the outer wall face 112 of the wall panel 110 can be sprayed with an adhesive and a moisture barrier 115 applied over this adhesive; or a moisture barrier 115 can be stapled to the outer wall face 112 of the wall panel 110.

Alternatively, in the foregoing implementation, the moisture barrier 115 can be placed in the base of the jig—in place of the first plastic sheet—prior to assembly of the structural elements 113 such that the moisture barrier 115 is integrated and incorporated into the wall panel 110 in situ rather than installed on the outer wall face 112 of the wall panel 110 after structural fabrication of the wall panel 110 is complete. Yet alternatively, the interior faces of the jig and jig cover can be sprayed with a mold release prior to injecting expanding foam around the structural elements and hardpoints 120; a moisture barrier 115 in sheet format can then be applied over the outer wall face 112 of the wall panel 110 once extracted from the jig, or the outer wall face 112 of the wall panel 110 can be coated with a liquid moisture barrier 115 or waterproofing material. Alternatively, the expanding foam can itself form a waterproofing membrane across the structural elements 113 and hardpoints 120.

Furthermore, in the foregoing implementation, pre-cast foam panels can alternatively be inserted between the structural elements 113 and hardpoints 120 in the wall panel 110, and expanding foam or other adhesive can be injected or applied between these precast foam panels and the structural elements 113 to bond this assembly together.

In one variation, the outer face 112 of a wall panel 110 includes a similar exterior wall hanger configured to locate and support an exterior façade panel 150. In this variation, exterior wall hangers—integrated into a row of wall panels 110 that collectively form a wall—can align to form a continuous exterior wall hanger, and exterior façade panels 150 can be set on a fastened to this continuous exterior façade panel 150 to complete the exterior façade across this wall.

However, a wall panel 110 can be constructed in any other way.

6. Floor Panel

As shown in FIGS. 1B and 4, a floor panel 130 includes: an exterior floor face defining a rectangular geometry; a set of floor panel hardpoints 132 defining vertical floor panel datums 133 along a top edge of the exterior floor face; and a load-bearing structure 134 coupled to the set of floor panel hardpoints 132 and inset from a maximal floor panel 130 dimension defined by the vertical floor panel datums 133. Generally, a floor panel 130 can be constructed according to a process and with materials similar to a wall panel 110 but with upper hardpoints located along one or more top edges of the floor panel 130 to mate with lower wall panel hardpoints 120 and with longitudinal sections (e.g., joists) configured to support vertical loads across an open span, such as between poured or precast concrete foundation elements below. For example, a floor panel 130 can define a relatively deep section (e.g., 12-18") to carry minimum residential live and dead loads over an open span up to 20' between foundation elements or other mooring. In this example, a floor panel 130 can be up to 20' in length of either 16", 24", or 32" in width, such as limited by a maximum weight (e.g., 200 pounds) maneuverable by four crewmen.

In particular, a floor panel 130 can be constructed with floor panel hardpoints 132 located—with a tight tolerance—at target positions of wall panel hardpoints 120 in the assembled structure in order to accurately and repeatably register these wall panels 110. For example, a first floor panel 130 designated for a structure can include a row of floor panel hardpoints 132 along one outer long edge of the floor panel 130, wherein each floor panel hardpoint 132 defines one upward-facing planar surface spanning two adjacent wall panel hardpoints 120 of two adjacent and abutting wall panels no at each wall panel no junction along this outer long edge of the floor panel 130. In this example, the first floor panel 130 can similarly include rows of floor panel hardpoints 132 along the two short edges of the floor panel 130; a first corner between the outer long edge of the floor panel 130 and one short end of the floor panel 130 can include a stop: defining an origin of the structure; and configured to mate with a lateral datum of a first side of a first wall panel 110 installed along this outer long edge of the floor panel 130 in order to register this first panel to the floor panel 130 along an x-axis of the structure; datums defined by hardpoints in a second wall panel 110 arranged adjacent and perpendicular to this first wall panel 110 can thus mate with datums defined by hardpoints in this first panel in order to register this second wall panel 110 along a y-axis of the structure. A last floor panel 130 can define a similar geometry, less a stop. Intermediate floor panel 130 between the first and last floor panels 130 can similarly define hardpoints—configured to mate with wall panel hardpoints 120—along their short ends.

In one example, a floor panel 130 defines a rectangular plan and includes: four floor-to-floor panel hardpoints 132 in each corner of the rectangular plan; fabricated steel c-channel joists (on 16" centers) extending between these four hardpoints; floor-to-wall panel hardpoints (e.g., some physically coextensive with the four floor-to-floor panel hardpoints 132) coupled to the joists and arranged across each target wall panel hardpoint 120 location, as described above; and foundation hardpoints configured to fasten to a foundation or other mooring, such as physically coextensive with the four floor-to-floor panel hardpoints 132 or otherwise coupled to the joists. In this example, two floor panels 130 can be fastened together such that adjacent c-channel joints in these abutting floor panels 130 form a rectangular closed-channel beam or an I-beam for greater torsional strength.

A floor panel 130 can also include: additional joists running along its length in order to increase its load-carrying capacity; pre-installed or formed-in-place moisture barriers 115 across the outer floor face 131 of the floor panel 130; and/or a final floor covering (e.g., wood flooring, carpet, an epoxy-based wear surface) arranged across a top face of the floor panel 130.

However, a floor panel 130 can define any other form or geometry and can be constructed in any other way.

7. Roof Panel

Figure 2:
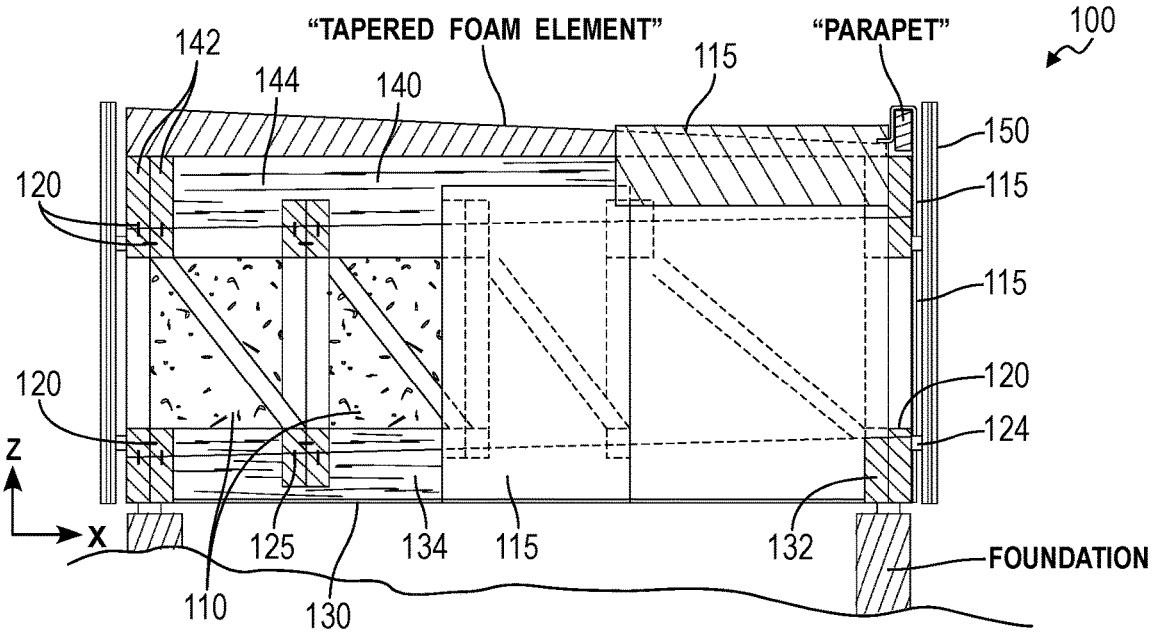
FIG. 2 is an elevation view of one variation of the panelized structural building system.

As shown in FIG. 2, the panelized structural building system 100 can further include roof panels 140. Generally, a roof panel 140 can define a form and geometry similar to that of a floor panel 130. The roof panel 140 can be constructed according to a process and with materials similar to a floor panel 130 but mirrored across a horizontal plane and sans features for anchoring to a foundation or other mooring.

For example, a roof panel 140 can be constructed on the same jig as a floor panel 130. Accordingly, the roof panel 140 can include: an inner roof face 141 (e.g., a ceiling face) defining a rectilinear geometry; a set of roof panel hardpoints 142 defining a row of vertical roof panel datums 143 proximal a bottom edge of the inner roof face 141; and a load-bearing structure 144 coupled to the set of roof panel hardpoints 142 and inset from a maximal roof panel dimension defined by the row of vertical roof panel datums 143. The roof panel 140 can therefore be assemblable over a set of wall panels no with the row of vertical roof panel datums 143 vertically located by vertical wall panel datums 122, 123—defined by pairs of upper wall panel hardpoints 120 in these wall panels 110—to set the height and position of the roof panel 140 over this wall panel no and the floor panel 130 below.

In one implementation, upon (or prior to) extraction of a roof panel 140 from a jig, pre-cast tapered foam sheets are bonded to the outer roof face of the roof panel 140 in order to form a slope for roof drainage. Alternatively, such slope can be formed directly into the roof panel 140, such as by molding a closed-cell foam between and around structural elements 144 in this roof panel 140 to form slope across the outer roof face of the roof panel 140.

However, a roof panel 140 can define any other form or geometry and can be constructed in any other way.

8. Example Assembly

In one example implementation shown in FIG. 2, a structure is assembled—for a first time—onsite with a set of floor, wall, and roof panels in the panelized structural building system 100. In this example implementation, once concrete is poured or once precast concrete piles are set in place to form a foundation, a set of floor panels 130 are carried to the job site by a set of (e.g., four) crewmen. A first floor panel 130 is then set on the foundation, plumbed and squared, and then fastened (e.g., with threaded fasteners) to the foundation at the floor-to-foundation hardpoints. A first corner of the first floor panel 130 can thus define an origin of the structure. A second floor panel 130 is then: set on the foundation adjacent the first floor panel 130 with abutting floor-to-floor panel hardpoints 132 in the first and second floor panels 130 driven into contact; plumbed and squared (e.g., with shims added between floor-to-foundation hardpoints and the foundation); fastened to the first floor panel 130 at the floor-to-floor panel hardpoints 132; and fastened to the foundation at the floor-to-foundation hardpoints. In one variation, gaps between adjacent joists in the first and second floor panels 130 are caulked after fastening, or a preformed gasket 116 (e.g., a low-durometer silicone gasket 116) is inserted into this gap before these floor-to-floor panel hardpoints 132 are bolted and tightened together.

In this example implementation, this process is repeated for additional floor panels 130 to complete a floor assembly of the structure.

Once the floor assembly is completed, a first wall panel no and a second wall panel 110—perpendicular to the first wall panel 110—are loosely installed around the first corner of the first floor panel 130 (i.e., over the origin of the structure), including locating the first lower hardpoint of the first wall panel no in contact with the stop at the first corner of the first floor panel 130. The first and second wall panels 110 are then checked for perpendicularity and tightened onto the first floor panel 130 with threaded fasteners running through lower hardpoints in the first wall panel 110 into bores in corresponding floor panel hardpoints 132 in the first floor panel 130. The adjacent upper and lower hardpoints of the first and second wall panels 110 can be similarly fastened and tightened together.

In one variation, a gap between the bottom edge of structural elements 113 in the first wall panel 110 and the top edge of the first floor panel 130 is filled with caulk or expanded foam once the first wall panel 110 is tightened onto the first floor panel 130. Alternatively, a preformed gasket 116 can be inserted into this gap or preinstalled on one of these surfaces; and the first wall panel no can be tightened onto the first floor panel 130 until adjacent hardpoint surfaces contact, thereby compressing the gasket 116 and sealing the first wall panel no to the first floor panel 130. The second wall panel 110 can be similarly sealed against the first floor panel 130 and the first wall panel 110.

This process is then repeated to loosely install a third wall panel no and a fourth wall panel 110—perpendicular to the third wall panel 110—at a second corner at the opposite end of the outer long edge of the first floor panel 130. Wall panels no can then be similarly loosely fastened to the floor panel 130 and to adjacent wall panels 110 in order to loosely assemble this first wall of the structure along this outer long edge of the first floor panel 130. This row of wall panels no can then be driven toward the first wall panel no to snug lateral hardpoints in these wall panels 110, and these wall panels 110 can then be tightened together and tightened against the first floor panel 130 in order to complete this first wall of the structure.

A first roof panel 140 can then be arranged parallel and overhead the first floor panel 130, set over this first wall, the second wall panel 110, and the fourth wall panel 110, and loosely fastened to the wall panels 110 below at corresponding hardpoints. Once checked for level and square, the first roof panel 140 can be tightened onto the wall panels 110 below to drive downward-facing roof panel hardpoints 142 onto corresponding upper wall panel hardpoints 120 in this first wall.

A next pair of wall panels 110 can then be fastened to the floor assembly panel at the second and fourth wall panels 110; a next roof panel 140 can be installed over this next pair of wall panels 110; abutting joists in this next roof panel 140 and the first roof panel 140 can be fastened together at roof-to-roof hardpoints to form closed-beam or I-beam ceiling joists, as described above; and this process can be repeated until all remaining wall panel 110 and reference points are installed to complete structural assembly.

In this example, "dummy" wall panels 110 can be similarly installed in the structure during assembly but either not fastened to adjacent structural panels or fastened and then removed from the assembly upon completion to form openings for doors and windows.

However, these floor, wall, and roof panels can be assembled in any other way and in any other order.

9. Weatherproofing

As described above and shown in FIG. 2, a moisture barrier 115 can be applied onto or integrated into the outer wall face 112 of a wall panel 110 during offsite construction.

9.1 Gasket

In one implementation shown in FIG. 2, a moisture barrier 115 is applied up to and around the perimeter of the outer wall face 112 of a wall panel 110. In this implementation, a rubber seal or compressible gasket 116 can be installed over a segment of the moisture barrier 115 that laps over the top, bottom, and left (or right) sides of the wall panel 110, such as during offsite construction or when the wall panel 110 is readied for onsite installation; when hardpoints in the wall panel 110 are then tightened against adjacent hardpoints in abutting floor, wall, and roof panels, the seal or gasket 116 can be compressed between the structural panels to weatherproof these structural panel junctions against water ingress.

For example, a first wall panel 110 can include a first set of wall panel hardpoints 120: that define a first set of lateral wall panel datums 121 facing outwardly from a left side of the first wall panel 110; and that define a first set of fastener bores 124 proximal the first set of lateral wall panel datums 121. Similarly, a second wall panel 110 can include a second set of wall panel hardpoints 120: that define a second set of lateral wall panel datums 121 facing outwardly from a right side of the second wall panel 110; and that define a second set of fastener bores 124 proximal the second set of lateral wall panel datums 121. In this example, the panelized structural building system 100 can further include a gasket 116 (e.g., a rubberized weather-strip) configured to install between the left side of the first wall panel 110 and the right side of the second wall panel 110 during assembly of the first and second wall panels 110 onto a floor panel 130. (Alternatively, the gasket 116 can be integrated into (e.g., bonded, fastened, or overmolded to) the left side of the first wall panel 110 or the right side of the second wall panel 110.) During assembly of these wall panels 110 into a section of a wall, a set of fasteners can be installed through the first set of fastener bores 124 and the second set of fastener bores 124 in hardpoints in the first wall panel 110 and the second wall panel 110 in order: to mate the first set of lateral wall panels 110 along the left side of the first wall panel 110 against the second set of lateral wall panels no along the right side of the second wall panel 110; and to compress the gasket 116 between the left side of the first wall panel no and the right side of the second wall panel 110. In the implementation described above in which the outer wall faces 112 of the wall panels 110 in the panelized structural building system 100 are sealed or include moisture barriers 115, the gasket 116 can thus cooperate with the outer wall faces 112 of the first and second wall panels no to form a continuous moisture barrier 115 across this wall section.

In this implementation, a gasket 116 can be similarly installed between the bottom faces of wall panels 110 and the top of the abutting floor panel 130 in order to form a continuous moisture barrier 115 across the outer wall faces 112 of these wall panels no and floor panel 130. Similarly, a gasket 116 can be installed between the top faces of wall panels no and the bottom of the abutting roof panel 140 in order to form a continuous moisture barrier 115 across the outer wall faces 112 of these wall panels 110 and roof panel 140.

Alternatively, in this implementation, gaps at junctions between abutting floor, wall, and roof panels can be caulked or sealed (e.g., with an elastomeric sealant or expanding foam) following assembly.

9.2 Moisture Barrier Flap

Additionally or alternatively, a moisture barrier flap 115 (e.g., 12"-wide adhesive-backed elastomeric flap) can be adhered over vertical and horizontal junctions between adjacent floor, wall, and roof panels upon completion of the structural assembly.

For example, each wall panel 110—in a set of wall panels 110 allocated for a building—can include a moisture barrier flap 115 extending laterally from a first side of the wall panel 110 and configured to overlap a junction between the first side of the wall panel 110 and a second side of an adjacent wall panel 110 fastened thereto. When assembled to form a wall, these wall panels 110 can first be fastened together and to the abutting floor panel 130; the moisture barrier flap 115 from each wall panel 110 can then be applied over a nearby section of the outer wall face 112 of the adjacent wall panel 110, such as by removing a backing from this moisture barrier flap 115 and sticking the moisture barrier flap 115 onto the adjacent wall panel 110. In this example, each wall panel 110 can similarly include a moisture barrier flap 115 extending beyond its bottom edge and configured to overlap a junction between the bottom edge of the wall panel 110 and the exterior face of an adjacent floor panel 130 fastened thereto. Furthermore, each roof panel 140 can similarly include a moisture barrier flap 115 extending beyond its bottom edge and configured to overlap a junction between the bottom edge of the roof panel 140 and faces of adjacent wall panels 110 fastened thereto.

Yet alternatively, a continuous moisture barrier 115 can be applied to or integrated into an outer wall face 112 of a wall panel 110 and can be extended across junctions between this wall panel 110 and an adjacent wall, roof, and/or floor panel 130. For example, a moisture barrier 115 can be: installed on the outer wall face 112 of a wall panel 110 during construction; trimmed to a top edge and right edge of the outer wall face 112 of the wall panel 110; and trimmed oversize to form flaps that extend beyond the left edge and the bottom edge of the outer wall face 112 of the wall panel 110 by a corresponding minimum overlap distance (e.g., 12" from the left edge; the full height of a floor panel 130 from the bottom edge). In this example, the moisture barrier 115 can be adhesive-backed, and a backing can be left in place on the flaps. These flaps can thus be rolled or folded back from the left and bottom edges of the wall panel 110 and taped or otherwise held away from hardpoints in this wall panel 110 during assembly at a job site. Thus, once floor, wall, and roof panels are assembled into a structure at the job site: the paper backing from this wall panel 110 can be removed from moisture barrier flaps 115; the left flap can be extended over a junction along the left edge of the wall panel 110 and adhered across a portion of the outer wall face 112 of the adjacent wall panel 110; and the bottom flap can be extended over a junction along the bottom edge of the wall panel 110 and adhered across a portion of the outer wall face 112 of the floor panel 130 below. This process can be repeated for each other wall panel 110 in the structure to seal junctions between the wall panel 110 and between these wall panels 110 and the floor assembly.

In the foregoing implementation, roof panels 140 can similarly include moisture barrier flaps 115 extending from left and bottom edges of their outer roof faces. Upon (or during) assembly of the structure, a moisture barrier flap 115 extending from the left edge of one roof panel 140 can be unwrapped and applied over the right edge and a portion of the outer roof face of an adjacent roof panel 140; and a moisture barrier flap 115 extending from the bottom edge of the roof panel 140 can be unwrapped and applied over the top edge and a portion of the outer wall face of an adjacent wall panel 110, thereby fully sealing the structure. A TPO or TPU membrane can be applied, bonded, and/or welded over the top surface of the completed roof assembly (e.g., over pre-cast tapered foam sheets arranged on the upper exterior surfaces of these roof panels 140) up to (and slightly past) the top edges of the roof assembly.

Additionally or alternatively, TPO or TPU membrane can be applied, bonded, and/or welded over the top surface of the completed roof, and this membrane can extend past the top edges of the roof assembly and down past junctions between these roof panels 140 and the wall panels 110 below in order to form a continuous seal over the top of the roof assembly and down a portion of these wall panels 110.

10. Exterior Façade

As described above and shown in FIG. 2, hardpoints in a wall panel 110 can also define exterior façade mounts 124 configured to accurately locate and retain an exterior façade panel 150, such as a rainscreen panel. In particular, because hardpoint geometry is tightly controlled during manufacturing and because relative locations of hardpoints in a wall panel 110 are tightly controlled during wall panel 110 construction, locations of exterior façade mounts 124 within each wall panel 110 in a completed structure can be known and tightly controlled regardless of an overall tolerance stack in the structure. Therefore, exterior façade panels 150 can be constructed with engagement features located at known positions of exterior façade mounts 124 in corresponding wall panels 110 in the structure, and one exterior façade panel 150 can be installed on each individual wall panel 110 (or across multiple adjacent wall panels 110) in order to eliminate need for onsite customization (e.g., or on-site trimming or modification) of these exterior façade panels 150 prior to installation.

In one implementation, a exterior façade panel 150 defines a nominal width equal to the nominal width of the corresponding wall panel 110, less a nominal gap distance (e.g., 0.150") between a vertical edge of the exterior façade panel 150 and an adjacent vertical edge of an adjacent exterior façade panel 150. Furthermore, in order to maintain a consistent, repeatable gap between adjacent vertical edges of adjacent exterior façade panels 150 once installed on a wall of like wall panels 110 (e.g., ranging from 0.110" to 0.190" across the entire structure) and in order to prevent interference between this exterior façade panel 150 and an adjacent exterior façade panel 150, the exterior façade panel 150 can be constructed with a tolerance—on its width dimension—similar to the width dimension tolerance of the corresponding wall panel 110 (e.g., +0.000/−0.020").

The exterior façade panel 150 can also include features configured to mount the exterior façade panel 150 directly to hardpoints in a corresponding wall panel 110. For example, the exterior façade panel 150 can include: shouldered pins extending from the rear of the exterior façade panel 150 near the top corners of the exterior façade panel 150; and threaded shafts or nuts extending from the rear of the exterior façade panel 150 near the bottom corners of the exterior façade panel 150. In this example, exterior façade mounts 124 in the upper hardpoints in the corresponding wall panel 110 can include keyhole features; and exterior façade mounts 124 in the lower hardpoints in this wall panel 110 can include smooth bores sized for clearance or transition fit with a threaded fastener. During onsite assembly, shouldered pins at the top corners of the exterior façade panel 150 can be inserted into the keyhole bores in the upper hardpoints in the corresponding wall panel 110. These keyhole features can thus locate the top edge of the exterior façade panel 150 against the wall panel 110 and set a lateral position of the upper corners of the exterior façade panel 150 relative to the wall panel 110. The exterior façade panel 150 can then be pivoted downward to bring the lower edge of the exterior façade panel 150 toward the lower hardpoints in this wall panel 110 and to bring threaded shafts or nuts in the lower corners of the exterior façade panel 150 into alignment with corresponding bores in the lower hardpoints in this wall panel 110. The lower corners of the exterior façade panel 150 are then fastened to the lower hardpoints of the wall panel 110, which can locate the bottom edge of the exterior façade panel 150 relative to the wall panel 110 and set a lateral position of the lower corners of the exterior façade panel 150 relative to the wall panel 110.

Alternatively, a cleat 117 can be integrated into or fastened onto exterior façade mounts 124 in hardpoints in each wall panel 110; and each exterior façade panel 150 can include shouldered fasteners, hooks, or other mating features extending rearward from (proximal) each corner of the exterior façade panel 150 and configured to drop into a cleat 117 on a wall panel hardpoint 120. Each exterior façade panel 150 can also include a latch 126 (shown in FIG. 6) or a fastener (shown in FIG. 4) configured to engage a corresponding feature on an adjacent wall panel 110 or roof panel 140 in order to prevent elevation of the exterior façade panel 150 off of these cleats 117, thereby locking the exterior façade panel 150 onto the adjacent wall panel 110.

Alternatively, each exterior façade mount 124 can include a smooth or threaded bore, a pin or slot, or another datum and mounting feature; and the panelized structural building system 100 can further include a set of separate cleats 117 configured to mount directly to these exterior façade mounts 124 during assembly of the building.

Furthermore, each exterior façade panel 150 can define a rainscreen panel that includes an inner façade face and can be configured to install onto exterior façade mounts 124—defined by a set of wall panel hardpoints 120 of a corresponding wall panel 110—with the inner façade face of the exterior façade panel 150 offset from an outer wall face of the wall panel 110. For example, the exterior façade mounts 124 on wall panel hardpoints 120 can define stops that mate with corresponding features on the back side of the exterior façade panel 150 such that the inner façade face of the exterior façade panel 150 is offset from the outer wall face 112 of the adjacent wall panel 110 (e.g., by 1" per 10' of exterior façade panel 150 height), thereby enabling air to flow upward and moisture to flow downward between the wall panel 110 and the exterior façade panel 150.

However, an exterior façade panel 150 can be installed on a wall panel 110 in any other way and can define any other geometry.

10.1 Geometry and Concealment

Therefore, in the foregoing implementations, wall, floor, and roof panels can be assembled to form a waterproof, structural building of tightly-controlled dimension and including exterior façade mounts 124 configured to repeatably and accurately locate and support a set of exterior façade panels 150, which conceal (i.e., visually obscure) moisture flaps, other waterproofing, structural elements, vertical and horizontal junctions between panels, outer faces of these panels more generally, harnessed wiring, mechanical elements (e.g., vents, radiant heating component), and/or plumbing incorporated into these wall panels 110. For example, each exterior façade panel 150 can span a width approximately equal to a width of its corresponding wall panel 110 (less a target or nominal vertical gap between adjacent exterior façade panels 150 in the final structure) such that the exterior façade panel 150 can install directly onto exterior façade mounts 124 defined by hardpoints in its corresponding wall panel 110. However, each exterior façade panel 150 can also span a height greater than the total assembled height of floor, wall, and roof panels in the structure such that the exterior façade panel 150 fully covers and conceals the adjacent outer faces of these floor, wall, and roof panels.

In one example shown in FIG. 5, each wall panel 110 can define a first height (e.g., 100"); each floor panel 130 can define a second height (e.g., 12"); and each roof panel 140 can define a height within a third range of heights (e.g., 10" to 18" to account for drainage slope). In this example, each exterior façade panel 150 can define a fourth height approximating or greater than the sum of the first height, the second height, and the maximum height in the third range of heights (e.g., 130"). Therefore, these exterior façade panels 150 can install onto exterior façade mounts 124 of wall panels 110: with upper edges of these exterior façade panels 150 extending above tops of these wall panels 110 to conceal abutting roof panels 140 and junctions between these wall panels 110 and abutting roof panels 140; and with lower edges of these exterior façade panels 150 extending below bottoms of these wall panels 110 to conceal abutting floor panels 130 and junctions between these wall panels 110 and abutting floor panels 130.

11. Interior Finish Panels 160

As described above, a wall panel 110 can also define interior finish receptacles configured to accurately locate and retain an interior finish element, such as a prefinished interior wall panel 110. For example, a prefinished interior wall panel 110 can include a finished surface, (e.g., such as automotive-grade paint or prefinished wood veneer) over a rigid substrate (e.g., MDF-faced plywood; aluminum-honeycomb-backed fiberglass) and can include a mounting feature 166—configured to engage an interior wall hanger 118—on its rear face 164.

In one implementation shown in FIGS. 1A, 3 and 4, a wall panel 110 is constructed in production (i.e., offsite) with an interior wall hanger 118 arranged on its inner wall face 112. When assembled into a wall onsite, multiple wall panels 110 form a continuous interior wall hanger 118 extending—at a consistent height from the floor panel 130 below—along the length of the wall. Prefinished interior wall panels 110 are then hung from this continuous interior wall hanger 118, as shown in FIG. 3. For example, the distance from mounting feature on the back of a prefinished interior wall panel 110 to the bottom edge of this prefinished interior wall panel 110 may be equal to the distance from an interior wall hanger 118 on a wall panel 110 to the bottom edge of the wall panel 110, less a target floor gap distance (e.g., 0.125") and finished floor thickness. Similarly, the distance from the mounting feature on the back of the prefinished interior wall panel 110 to the top edge of the prefinished interior wall panel 110 may be equal to the distance from the interior wall hanger 118 on a wall panel 110 to the top edge of the wall panel 110, less a target ceiling gap distance (e.g., 0.125") and finished interior ceiling panel (e.g., 3"). When installed, a prefinished interior wall panel 110 may therefore form a consistent gap between its lower edge and a finished floor below and between its top edge and a finished ceiling panel above.

However, these prefinished interior wall panels 110 may not necessarily be the same width as wall panels 110 that form this wall. Because wall panels 110 in a completed linear wall form a continuous interior wall hanger 118, multiple (wider or narrow) prefinished interior wall panels 110 may be quickly installed onto this wall while preserving opportunity for crewmen to quickly set and control vertical gaps between adjacent prefinished interior wall panels 110. For example, once wall, floor, and roof panels 140 are assembled to form a structure with first, second, third, and fourth walls, a first set of prefinished interior wall panels 110 are loosely set on a first continuous interior wall hanger 118 formed by discrete interior wall hangers 118 located on inner wall faces 112 of a first set of wall panels 110 that form the first wall of the structure. The left edge of a first prefinished interior wall panel 110 on this first set of wall panels 110—located proximal a first internal corner of the structure—is then located at a target distance—equal to the sum of the depth of these prefinished interior wall panels 110, a target corner gap distance (e.g., 0.125"), and a depth of the mounting features—from the adjacent fourth wall. Edges of the remaining prefinished interior wall panels 110 on the first wall are then set at target gap distances (e.g., 0.000", 0.125") such that any variance in total width of this first set of prefinished interior wall panels 110 from the width of the first wall—such as due to lower-tolerance production of these prefinished interior wall panels 110—is stored in the second internal corner of structure.

A second set of prefinished interior wall panels 110 are then loosely set on a second continuous interior wall hanger 118 formed by discrete interior wall hangers 118 located on inner wall faces 112 of a second set of wall panels 110 that form the second wall of the structure. At the second internal corner of the structure, the left edge of a first prefinished interior wall panel 110 on this second set is offset from the last prefinished interior wall panel 110 on the first wall by the target corner gap distance (e.g., 0.125"). The first prefinished interior wall panel 110 in this second set can thus hide any surplus or shortage of total length of the first set of prefinished interior wall panels 110 on the first wall. Edges of the remaining prefinished interior wall panels 110 on the second wall are then set at target gap distances such that any variance in total width of this second set of prefinished interior wall panels 110 from the width of the second wall is stored in the third internal corner of the structure.

This process can then be repeated to install third and fourth sets of prefinished interior wall panels 110 on the third and fourth wall, including: hiding any surplus or shortage of total length of the third set of prefinished interior wall panels 110 (installed on the third wall) with prefinished interior wall panels 110 installed on the fourth wall; and hiding any surplus or shortage of total length of the fourth set of prefinished interior wall panels 110 (installed on the fourth wall) with prefinished interior wall panels 110 installed on the first wall.

11.1 Example

Therefore, in one example, each wall panel 110 can include: inner and outer wall faces 111, 112 of a first width (e.g., 48"); a set of hardpoints defining vertical and lateral datums proximal corners of the outer wall face 112; and an interior wall hanger 118 (e.g., an undercut slot, molding, or reglet) extending laterally across the inner wall face 112 of the wall panel 110. Each interior finish panel 160 can include: a pre-finished interior face 162 defining a second width different from (e.g., less than) the first width (e.g., 36"); a rear face 164 opposite the finished interior face 162; and a mounting feature (e.g., a hook) arranged on the rear face 164. Accordingly, a set of wall panels 110 are assemblable into a wall—as described above—with their interior wall hangers 118 aligning to form a continuous track along a length of the wall. The set of interior finish panels 160 are thus configured to install onto this continuous track to conceal inner wall faces 112 of the wall panels 110 that form this wall.

Furthermore, a first floor panel 130—defining one outermost edge of a rectangular floor plan—can include a first row of floor panel hardpoints 132 along its length, and a first set of wall panels 110 can be installed onto this first row of floor panel hardpoints 132 in the first floor panel 130. The first floor panel 130 can also include sub-rows of floor panel hardpoints 132 extending along its short ends perpendicular to the first row of floor panel hardpoints 132. Similarly, a second floor panel 130—configured to mate to the first floor panel 130—can include sub-rows of floor panel hardpoints 132 extending along its short ends perpendicular to its long axis. Thus, the first floor panel 130 and the second floor panel 130—and additional floor panels 130 similar to the second floor panel 130—can be assembled to form a continuous floor structure with sub-rows of floor panel hardpoints 132 along each side of the continuous floor structure aligning to form a second row and a third row of floor panel hardpoints 132 perpendicular to the first row of floor panel hardpoints 132. Furthermore, a third floor panel 130—such as similar to and/or mirroring the first floor panel 130 and installed on the continuous floor structure opposite the first floor panel 130—can define a fourth row of floor panel hardpoints 132 parallel to the first row of floor panel hardpoints 132. Thus: a second set of wall panels no can be installed onto the second row of floor panel hardpoints 132; a third set of wall panels 110 can be installed onto the third row of floor panel hardpoints 132; and a fourth set of wall panels 110 can be installed onto the fourth row of floor panel hardpoints 132 to form a four-sided structure.

Furthermore, each set of wall panels 110 assembled onto a corresponding row of floor panel hardpoints 132 in the continuous floor structure can form a continuous wall with a continuous track along its interior face. More specifically, the first set of wall panels 110 can be assembled into a first wall with their interior wall hangers 118 aligning to form a first continuous track along the length of the first wall; and the second set of wall panels 110 can be assembled into a second wall—perpendicular to and intersecting the first wall—with their interior wall hangers 118 aligning to form a second continuous track along a second length of the second wall.

Accordingly, a first row of interior finish panels 160 can be installed onto the first continuous track defined along the first wall with a first end of a first interior finish panel 160—in this first row of interior finish panels 160—a) located proximal a corner formed by the first wall and the second wall and b) offset from an inner face of the second wall at an uncontrolled corner gap distance to accommodate a surplus or shortage of the total length of this first row of interior finish panels 160 relative to the total length of the first wall.

Furthermore, a second row of interior finish panels 160 can be installed onto the second continuous track with a second end of a second interior finish panel 160—in this second row of interior finish panels 160—a) located proximal the corner formed by the first wall and the second wall and b) offset from a first finished interior face 162 of the first interior finish panel 160 at a controlled corner gap distance (e.g., 0.125") to conceal the uncontrolled corner gap distance thus formed between the first end of the first panel in the first row of interior finish panels 160 and an inner wall face 112 of a first wall panel 110 in the second of wall panels 110.

The pattern of a second end of a row of interior finish panels 160 concealing any uncontrolled corner gap distances—formed between a first end of an adjacent row of interior finish panels 160 and an inner wall face 112 of an adjacent first wall panel 110—can be repeated at each other interior corner of the building in order to achieve consistent gaps and finish details inside the building while reducing dimensional tolerance requirements of interior finish panels 160 installed in the building.

As a person skilled in the art will recognize from the previous detailed description and from the figures and claims, modifications and changes can be made to the embodiments of the invention without departing from the scope of this invention as defined in the following claims.

We claim:

1. A panelized structural building system comprising:

a set of wall panels, each wall panel in the set of wall panels comprising:

an outer wall face;

a set of wall panel hardpoints, each wall panel hardpoint in the set of wall panel hardpoints:

arranged proximal a corner of the outer wall face;

defining a lateral wall panel datum facing outwardly from a side of the wall panel; and defining an exterior façade mount facing outwardly from the outer wall face; and a load-bearing structure extending between the set of wall panel hardpoints and inset from a maximal wall panel perimeter defined by the set of wall panel hardpoints;

a set of exterior façade panels;

wherein the set of wall panels are assemblable into a wall with lateral wall panel datums, defined by wall panel hardpoints in adjacent wall panels in the set of wall panels, abutting to laterally space the set of wall panels along the wall; and wherein the set of exterior façade panels are configured to install onto exterior façade mounts, defined by sets of wall panel hardpoints of wall panels in the set of wall panels, to conceal outer wall faces of wall panels in the set of wall panels; and wherein a first wall panel in the set of wall panels comprises:

a pair of lower wall panel hardpoints, in the set of wall panel hardpoints:

comprising rigid structures of a first thickness;

defining lower corners of the first wall panel;

defining a pair of opposing lower lateral wall panel datums facing outwardly from opposing sides of the first wall panel; and defining a pair of lower vertical wall panel datums facing downwardly from a bottom of the first wall panel;

a pair of upper wall panel hardpoints, in the set of wall panel hardpoints:

comprising rigid structures of the first thickness;

defining upper corners of the first wall panel;

defining a pair of opposing upper lateral wall panel datums facing outwardly from opposing sides of the first wall panel; and defining a pair of upper vertical wall panel datums facing upwardly from a top of the first wall panel;

a set of folded sheetmetal elements:

of a second thickness less than the first thickness;

arranged about a perimeter of the first wall panel;

coupling the pair of lower wall panel hardpoints and the pair of upper wall panel hardpoints; and forming a first load-bearing structure within the first panel; and an insulator occupying a volume between the set of folded sheetmetal elements, the pair of lower wall panel hardpoints, and the pair of upper wall panel hardpoints.

2. The panelized structural building system of claim 1:

wherein a second wall panel in the set of wall panels comprises:

a second pair of lower wall panel hardpoints, in a second set of wall panel hardpoints:

defining lower corners of the second wall panel;

defining a second pair of opposing lower lateral wall panel datums facing outwardly from opposing sides of the second wall panel; and defining a second pair of lower vertical wall panel datums facing downwardly from a bottom of the wall panel;

further comprising a floor panel comprising:

an outer floor face defining a rectilinear geometry;

a set of floor panel hardpoints defining a row of vertical floor panel datums proximal a top edge of the outer floor face; and a wall-bearing structure coupled to the set of floor panel hardpoints and inset from a maximal floor panel dimension defined by the row of vertical floor panel datums; and wherein the first wall panel and the second wall panel are assemblable onto the floor panel with the row of vertical floor panel datums vertically locating vertical wall panel datums, defined by pairs of lower wall panel hardpoints in the first wall panel and the second wall panel, over the floor panel.

3. The panelized structural building system of claim 1:

wherein each wall panel in the set of wall panels defines a first height;

wherein each exterior façade panel in the set of exterior façade panels defines a second height greater than the first height; and wherein the set of exterior façade panels are configured to install onto exterior façade mounts, defined by sets of wall panel hardpoints of wall panels in the set of wall panels, with upper edges of exterior façade panels in the set of exterior façade panels extending above a top of the wall to conceal a roof panel installed over the wall.

4. The panelized structural building system of claim 1:

wherein each wall panel in the set of wall panels further comprises:

an inner wall face defining a first width; and an interior wall hanger extending laterally across the inner wall face;

further comprising a set of interior finish panels, each interior finish panel in the set of interior finish panels comprising:

a finished interior face defining a second width different from the first width;

a rear face opposite the finished interior face; and a mounting feature arranged on the rear face;

wherein the set of wall panels are assemblable into the wall with interior wall hangers, of the set of wall panels, aligning to form a continuous track along a length of the wall; and wherein the set of interior finish panels are configured to install onto the continuous track to conceal inner wall faces of wall panels in the set of wall panels.

5. The panelized structural building system of claim 4:

wherein a first subset of wall panels in the set of wall panels are assemblable into a first portion of the wall with interior wall hangers, of the first subset of wall panels, aligning to form a first portion of the continuous track;

wherein a second subset of wall panels in the set of wall panels are assemblable into a second portion of the wall, perpendicular to the first portion of the wall, with interior wall hangers, of the second subset of wall panels, aligning to form a second portion of the continuous track;

wherein a first subset of interior finish panels in the set of interior finish panels are configured to install onto the first portion of the continuous track with a first end of a first interior finish panel, in the first subset of interior finish panels, located proximal a corner between the first portion of the wall and the second portion of the wall and offset from an inner wall face of the second portion of the wall at an uncontrolled corner gap distance; and wherein a second subset of interior finish panels in the set of interior finish panels are configured to install onto the second portion of the continuous track with a second end of a second interior finish panel, in the second subset of interior finish panels, located proximal the corner between the first portion of the wall and the second portion of the wall and offset from a first finished interior face of the first interior finish panel at a controlled corner gap distance to conceal the uncontrolled corner gap distance.

6. A panelized structural building system comprising:

a set of wall panels, each wall panel in the set of wall panels comprising:

an outer wall face;

a set of wall panel hardpoints, each wall panel hardpoint in the set of wall panel hardpoints:

arranged proximal a corner of the outer wall face;

defining a lateral wall panel datum facing outwardly from a side of the wall panel; and defining an exterior façade mount facing outwardly from the outer wall face;

a load-bearing structure extending between the set of wall panel hardpoints and inset from a maximal wall panel perimeter defined by the set of wall panel hardpoints; and a moisture barrier flap extending laterally from a first side of the wall panel and configured to overlap a junction between the first side of the wall panel and a second side of a second wall panel, in the set of wall panels, fastened to the wall panel; and a set of exterior façade panels;

wherein the set of wall panels are assemblable into a wall with lateral wall panel datums, defined by wall panel hardpoints in adjacent wall panels in the set of wall panels, abutting to laterally space the set of wall panels along the wall;

wherein the set of exterior façade panels are configured to install onto exterior façade wall panels, to conceal outer wall faces of wall panels in the set of wall panels; and wherein each exterior façade panel, in the set of exterior façade panels:

comprises a rainscreen panel defining an inner façade face; and is configured to install onto exterior façade mounts, defined by a set of wall panel hardpoints of a wall panel in the set of wall panels, with the inner façade face of the exterior façade panel offset from an outer wall face of the wall panel and concealing a moisture barrier flap overlapped onto the outer wall face of the wall panel.

7. The panelized structural building system of claim 6:

wherein the first wall panel, in the set of wall panels, comprises:

a first set of wall panel hardpoints:

defining a first set of lateral wall panel datums facing outwardly from a left side of the first wall panel; and defining a first set of fastener bores proximal the first set of lateral wall panel datums;

wherein a second wall panel, in the set of wall panels, comprises:

a second set of wall panel hardpoints:

defining a second set of lateral wall panel datums facing outwardly from a right side of the second wall panel; and defining a second set of fastener bores proximal the second set of lateral wall panel datums;

further comprising a gasket configured to install between the left side of the first wall panel and the right side of the second wall panel; and wherein the first wall panel and the second wall panel are assemblable into a section of the wall by a set of fasteners installed through the first set of fastener bores and the second set of fastener bores:

to mate the first set of lateral wall datums against the second set of lateral wall datums; and to compress the gasket between the left side of the first wall panel and the right side of the second wall panel.

8. A panelized structural building system comprising:

a set of wall panels, each wall panel in the set of wall panels comprising:

an inner wall face defining a first width;

an interior wall hanger extending laterally across the inner wall face;

a set of wall panel hardpoints, each wall panel hardpoint in the set of wall panel hardpoints:

arranged proximal a corner of the inner wall face; and defining a lateral wall panel datum facing outwardly from a side of the wall panel; and a load-bearing structure extending between the set of wall panel hardpoints and inset from a maximal wall panel perimeter defined by the set of wall panel hardpoints; and a set of interior finish panels, each interior finish panel in the set of interior finish panels comprising:

a finished interior face defining a second width different from the first width;

a rear face opposite the finished interior face; and a mounting feature arranged on the rear face;

wherein the set of wall panels are assemblable into a wall:

with lateral wall panel datums, defined by wall panel hardpoints in adjacent wall panels in the set of wall panels, abutting to laterally space the set of wall panels along the wall; and with interior wall hangers, of the set of wall panels, aligning to form a continuous track along a length of the wall;

wherein a first subset of wall panels in the set of wall panels are assemblable into a first portion of the wall with interior wall hangers, of the first subset of wall panels, aligning to form a first portion of the continuous track;

wherein a second subset of wall panels in the set of wall panels are assemblable into a second portion of the wall, perpendicular to the first portion of the wall, with interior wall hangers, of the second subset of wall panels, aligning to form a second portion of the continuous track;

wherein the set of interior finish panels are configured to install onto the continuous track to conceal inner wall faces of wall panels in the set of wall panels;

wherein a first subset of interior finish panels in the set of interior finish panels are configured to install onto the first portion of the continuous track with a first end of a first interior finish panel, in the first subset of interior finish panels, located proximal a corner between the first portion of the wall and the second portion of the wall and offset from an inner wall face of the second portion of the wall at an uncontrolled corner gap distance; and wherein a second subset of interior finish panels in the set of interior finish panels are configured to install onto the second portion of the continuous track with a second end of a second interior finish panel, in the second subset of interior finish panels, located proximal the corner between the first portion of the wall and the second portion of the wall and offset from a first finished interior face of the first interior finish panel at a controlled corner gap distance to conceal the uncontrolled corner gap distance.

9. The panelized structural building system of claim 8:

wherein each wall panel in the set of wall panels further comprises an outer wall face;

wherein each wall panel hardpoint in a set of wall panel hardpoints in a wall panel in the set of wall panels defines an exterior façade mount facing outwardly from an outer wall face of the wall panel; and further comprising a set of exterior façade panels, each exterior façade panel in the set of exterior façade panels configured to install onto exterior façade mounts, defined by a set of wall panel hardpoints of a wall panel in the set of wall panels, to conceal an outer wall face of the wall panel.

10. A panelized structural building system comprising:

a set of wall panels, each wall panel in the set of wall panels comprising:

an outer wall face defining a first rectilinear geometry;

a set of wall panel hardpoints defining a constellation of vertical wall panel datums and lateral wall panel datums proximal corners of the outer wall face; and a load-bearing structure extending between the set of wall panel hardpoints and inset from a maximal wall panel perimeter defined by the constellation of wall panel datums; and a first floor panel comprising:

a first outer floor face defining a second rectilinear geometry;

a first set of floor panel hardpoints defining a first row of vertical floor panel datums proximal a top edge of the first outer floor face; and a first wall-bearing structure coupled to the first set of floor panel hardpoints and inset from a first maximal floor panel dimension defined by the first row of vertical floor panel datums;

wherein a first wall panel in the set of wall panels comprises:

a pair of lower wall panel hardpoints, in the set of wall panel hardpoints:

comprising rigid structures of a first thickness;

defining lower corners of the first wall panel;

defining a pair of opposing lower lateral wall panel datums, in the constellation of vertical wall panel datums and lateral wall panel datums, facing outwardly from opposing sides of the first wall panel; and defining a pair of lower vertical wall panel datums, in the constellation of vertical wall panel datums and lateral wall panel datums, facing downwardly from a bottom of the first wall panel;

a pair of upper wall panel hardpoints, in the set of wall panel hardpoints:

comprising rigid structures of the first thickness;

defining upper corners of the first wall panel;

defining a pair of opposing upper lateral wall panel datums, in the constellation of vertical wall panel datums and lateral wall panel datums, facing outwardly from opposing sides of the first wall panel; and defining a pair of upper vertical wall panel datums, in the constellation of vertical wall panel datums and lateral wall panel datums, facing upwardly from a top of the first wall panel;

a set of folded sheetmetal elements:

of a second thickness less than the first thickness;

arranged about a perimeter of the first wall panel;

coupling the pair of lower wall panel hardpoints and the pair of upper wall panel hardpoints; and forming a first load-bearing structure of the first wall panel; and an insulator occupying a volume between the set of folded sheetmetal elements, the pair of lower wall panel hardpoints, and the pair of upper wall panel hardpoints.

11. The panelized structural building system of claim 10:

wherein the pair of lower wall panel hardpoints in the first wall panel define the pair of opposing lower lateral wall panel datums offset by a target wall panel width dimension, within a tolerance range of +0.000" and −0.020"; and wherein the pair of upper wall panel hardpoints in the first wall panel define the pair of opposing upper lateral wall panel datums offset by the target wall panel width dimension, within the tolerance range of +0.000" and −0.020".

12. The panelized structural building system of claim 10:

wherein each wall panel hardpoint in the first wall panel comprises a cuboid structure fabricated in steel plate;

wherein each folded sheetmetal element in the set of folded sheetmetal elements in the first wall panel comprises a folded sheet steel structure fastened to a subset of wall panel hardpoints in the first wall panel; and wherein the insulator in the first wall panel comprises a closed-cell foam molded within the first wall panel.

13. The panelized structural building system of claim 10:

wherein the first wall panel in the set of wall panels:

spans a first width;

spans a first height; and defines a first outer wall face between the pair of lower wall panel hardpoints and the pair of upper wall panel hardpoints;

wherein the pair of upper wall panel hardpoints further define a set of exterior façade mounts facing outwardly from the first outer wall face of the first wall panel; and further comprising an exterior façade panel:

defining a width approximating the first width of the first wall panel;

defining a second height greater than the first height; and configured to install onto the set of exterior façade mounts with an upper edge of the exterior façade panel extending above the top of the first wall panel and with a lower edge of the exterior façade panel extending below the bottom of the first wall panel to conceal a section of the first floor panel supporting the first wall panel.

14. The panelized structural building system of claim 10, wherein the set of wall panels are:

assemblable onto the first floor panel with the first row of vertical floor panel datums vertically locating vertical wall panel datums, defined by wall panel hardpoints in the set of wall panels, over the first floor panel; and assemblable into a first wall with lateral wall panel datums, defined by wall panel hardpoints in adjacent wall panels in the set of wall panels, abutting to laterally space the set of wall panels along the first row of vertical floor panel datums.

15. The panelized structural building system of claim 14:

further comprising a first roof panel comprising:

a first inner roof face defining a third rectilinear geometry;

a first set of roof panel hardpoints defining a first row of vertical roof panel datums proximal a bottom edge of the first inner roof face; and a first bearing structure coupled to the first set of roof panel hardpoints and inset from a first maximal roof panel dimension defined by the first row of vertical roof panel datums;

wherein the first roof panel is assemblable over the wall with the first row of vertical roof panel datums vertically locating vertical wall panel datums, defined by wall panel hardpoints in the set of wall panels, under the first roof panel; and wherein the set of wall panels, the first floor panel, and the first roof panel are assemblable to form a dwelling.

16. The panelized structural building system of claim 14:

wherein the first floor panel further comprises a second set of floor panel hardpoints proximal a first end of the first outer floor face;

further comprising a second floor panel comprising:

a second outer floor face;

a third set of floor panel hardpoints proximal a first end of the second outer floor face; and a second wall-bearing structure coupled to the third set of floor panel hardpoints and inset from a second maximal floor panel dimension defined by the third set of floor panel hardpoints;

wherein the first floor panel and the second floor panel are assemblable to form a floor structure with the second set of floor panel hardpoints and the third set of floor panel hardpoints aligned to form a second row of vertical floor panel datums perpendicular to the first row of vertical floor panel datums; and wherein the set of wall panels are further:

assemblable onto the floor structure with the second row of vertical floor panel datums vertically locating vertical wall panel datums, defined by wall panel hardpoints in the set of wall panels, over the floor structure; and assemblable into a second wall with lateral wall panel datums, defined by wall panel hardpoints in adjacent wall panels in the set of wall panels, abutting to laterally space the set of wall panels along the second row of vertical floor panel datums.

17. The panelized structural building system of claim 16:

wherein each wall panel in the set of wall panels further comprises:

an inner wall face defining a first width; and an interior wall hanger extending laterally across the inner wall face;

further comprising a set of interior finish panels, each interior finish panel in the set of interior finish panels comprising:

a finished interior face defining a second width different from the first width;

a rear face opposite the finished interior face; and a mounting feature arranged on the rear face;

wherein the set of wall panels are assemblable into the wall with interior wall hangers, of the set of wall panels, aligning to form a continuous track along a length of the wall; and wherein the set of interior finish panels are configured to install onto the continuous track to conceal inner wall faces of wall panels in the set of wall panels.

18. A panelized structural building system comprising:

a set of wall panels, each wall panel in the set of wall panels comprising:

an outer wall face;

a set of wall panel hardpoints, each wall panel hardpoint in the set of wall panel hardpoints:

arranged proximal a corner of the outer wall face; and defining a lateral wall panel datum facing outwardly from a side of the wall panel;

an inner wall face defining a first width;

an interior wall hanger extending laterally across the inner wall face; and wherein the set of wall panels are assemblable into a wall with interior wall hangers, of the set of wall panels, aligning to form a continuous track along a length of the wall;

a set of interior finish panels, each interior finish panel in the set of interior finish panels comprising:

a finished interior face defining a second width different from the first width;

a rear face opposite the finished interior face;

a mounting feature arranged on the rear face; and wherein the set of interior finish panels are configured to install onto the continuous track to conceal inner wall faces of wall panels in the set of wall panels;

wherein a first subset of wall panels in the set of wall panels are assemblable into a first portion of the wall with interior wall hangers, of the first subset of wall panels, aligning to form a first portion of the continuous track;

wherein a second subset of wall panels in the set of wall panels are assemblable into a second portion of the wall, perpendicular to the wall, with interior wall hangers, of the second subset of wall panels, aligning to form a second portion of the continuous track;

wherein a first subset of interior finish panels in the set of interior finish panels are configured to install onto the first portion of the continuous track with a first end of a first interior finish panel, in the first subset of interior finish panels, located proximal a corner between the first portion of the wall and the second portion of the wall and offset from an inner wall face of the second portion of the wall at an uncontrolled corner gap distance; and wherein a second subset of interior finish panels in the set of interior finish panels are configured to install onto the second portion of the continuous track with a second end of a second interior finish panel, in the second subset of interior finish panels, located proximal the corner between the first portion of the wall and the second portion of the wall and offset from a first finished interior face of the first interior finish panel at a controlled corner gap distance to conceal the uncontrolled corner gap distance.

19. The panelized structural building system of claim 18:

wherein each wall panel hardpoint in a set of wall panel hardpoints in a wall panel in the set of wall panels defines an exterior façade mount facing outwardly from an outer wall face of the wall panel; and further comprising a set of exterior façade panels, each exterior façade panel in the set of exterior façade panels configured to install onto exterior façade mounts, defined by a set of wall panel hardpoints of a wall panel in the set of wall panels, to conceal the outer wall face of the wall panel.

20. The panelized structural building system of claim 18: further comprising a first floor panel comprising:

a first outer floor face defining a first rectilinear geometry;

a first set of floor panel hardpoints defining a first row of vertical floor panel datums proximal a top edge of the first outer floor face; and a first wall-bearing structure coupled to the first set of floor panel hardpoints and inset from a first maximal floor panel dimension defined by the first row of vertical floor panel datums;

further comprising a first roof panel comprising:

a first inner roof face defining a second rectilinear geometry;

a first set of roof panel hardpoints defining a first row of vertical roof panel datums proximal a bottom edge of the first inner roof face; and a first bearing structure coupled to the first set of roof panel hardpoints and inset from a first maximal roof panel dimension defined by the first row of vertical roof panel datums;

wherein the first roof panel is assemblable over the wall with the first row of vertical roof panel datums vertically locating vertical wall panel datums, defined by wall panel hardpoints in the set of wall panels, under the first roof panel; and wherein the set of wall panels, the first floor panel, and the first roof panel are assemblable to form a dwelling.

* * * * *